US009933201B2

(12) United States Patent
Yi et al.

(10) Patent No.: US 9,933,201 B2
(45) Date of Patent: Apr. 3, 2018

(54) REFRIGERATOR

(71) Applicant: LG ELECTRONICS INC., Seoul (KR)

(72) Inventors: Myeongha Yi, Seoul (KR); Jaeyoul Lee, Seoul (KR); Taegyeong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 152 days.

(21) Appl. No.: 14/959,124

(22) Filed: Dec. 4, 2015

(65) Prior Publication Data

US 2016/0161174 A1 Jun. 9, 2016

(30) Foreign Application Priority Data

Dec. 4, 2014 (KR) ..... 10-2014-0173106

(51) Int. Cl.

| | |
|---|---|
| ***F25D 21/14*** | (2006.01) |
| ***F25D 23/06*** | (2006.01) |
| ***F25D 23/02*** | (2006.01) |
| ***F25D 11/02*** | (2006.01) |
| *F25D 25/02* | (2006.01) |

(52) U.S. Cl.

CPC ..... *F25D 21/14* (2013.01); *F25D 11/02* (2013.01); *F25D 23/02* (2013.01); *F25D 23/062* (2013.01); *F25D 23/067* (2013.01); *F25D 25/024* (2013.01)

(58) Field of Classification Search

CPC ..... F25D 21/14; F25D 11/02; F25D 23/062; F25D 23/02; F25D 25/02; F25D 2500/02; F25D 25/04; F25D 23/067; F25D 25/024; A47B 96/04; A47B 57/06; A47B 96/02

USPC ..... 62/285, 441

See application file for complete search history.

(56) References Cited

U.S. PATENT DOCUMENTS

| | | | | |
|---|---|---|---|---|
| 2,432,931 A | | 12/1947 | Peltier | |
| 2,622,412 A | | 12/1952 | Staebler | |
| 5,199,778 A | * | 4/1993 | Aoki ..... | A47B 57/32 108/147 |

(Continued)

FOREIGN PATENT DOCUMENTS

| | | |
|---|---|---|
| CN | 1184924 | 6/1998 |
| KR | 10-2006-0039168 | 5/2006 |
| KR | 10-2014-0059017 | 5/2014 |

OTHER PUBLICATIONS

Chinese Office Action in Chinese Application No. 201510883321.5, dated Jul. 31, 2017, 19 pages (with English translation).

(Continued)

*Primary Examiner* — Mohammad M Ali
(74) *Attorney, Agent, or Firm* — Fish & Richardson P.C.

(57) ABSTRACT

A refrigerator that includes a cabinet; a storage compartment located in the cabinet; a door mounted to the cabinet and configured to open or close at least a portion of the storage compartment; a freezing compartment provided in an upper region of the cabinet; an evaporator configured to cool the freezing compartment; an elevating frame provided at a lower part of the freezing compartment, the elevating frame being configured to move vertically and defining an expanded freezing compartment based on the elevating frame being moved downward; and fixed frames that are secured to respective sidewalls of the storage compartment and that are configured to guide and support vertical movement of the elevating frame is disclosed.

31 Claims, 12 Drawing Sheets

(56) References Cited

U.S. PATENT DOCUMENTS

| | | | | |
|---|---|---|---|---|
| 8,047,623 | B2 * | 11/2011 | Kang | A47B 57/06 312/408 |
| 2005/0262863 | A1 * | 12/2005 | Iguchi | F25D 19/02 62/298 |
| 2008/0246382 | A1 * | 10/2008 | Kang | A47B 57/06 312/408 |
| 2010/0176704 | A1 * | 7/2010 | Kim | F25D 25/024 312/408 |
| 2013/0269910 | A1 * | 10/2013 | De Piero | F28D 15/00 165/104.11 |

OTHER PUBLICATIONS

Partial European Search Report issued in European Application No. 15198015.8 dated Apr. 5, 2016, 7 pages.

* cited by examiner

REFRIGERATOR

CROSS-REFERENCE TO RELATED APPLICATION

Pursuant to 35 U.S.C. § 119(a), this application claims the benefit of Korean Patent Application No. 10-2014-0173106, filed on, Dec. 4, 2014, which is hereby incorporated by reference as if fully set forth herein.

TECHNICAL FIELD

The present disclosure generally relates to a refrigerator.

BACKGROUND

A refrigerator is an apparatus keeping foods fresh using cold air generated by a refrigeration cycle. For example, a refrigerator may include a compressor, a condenser, an expansion valve, and an evaporator.

SUMMARY

A refrigerator has a structure that ensures the effective drainage of defrosting water to prevent the defrosting water from flowing.

In general, one aspect of the subject matter described in this specification may be embodied in a refrigerator that includes a cabinet; a storage compartment located in the cabinet; a door mounted to the cabinet and configured to open or close at least a portion of the storage compartment; a freezing compartment provided in an upper region of the cabinet; an evaporator configured to cool the freezing compartment; an elevating frame provided at a lower part of the freezing compartment, the elevating frame being configured to move vertically and defining an expanded freezing compartment based on the elevating frame being moved downward; and fixed frames that are secured to respective sidewalls of the storage compartment and that are configured to guide and support vertical movement of the elevating frame. The fixed frames provided at the respective sidewalls of the storage compartment include a pair of fixed guides, and the elevating frame includes a bottom plate portion extending from a first fixed guide to a second fixed guide in the pair of fixed guides. The refrigerator further includes a support bar pivotably provided between the elevating frame and the fixed frames, the support bar being configured to guide and support the vertical movement of the elevating frame. The refrigerator further includes a plurality of support bars pivotably provided between the elevating frame and the fixed frames, the plurality of support bars being configured to guide and support the vertical movement of the elevating frame, and each of the support bars is spaced apart from each other in a front-and-rear direction. Each of the plurality of support bars includes a pivot shaft portion rotatably mounted to the bottom plate portion of the elevating frame and configured to support the bottom plate portion across a horizontal direction; support shaft portions bent from both ends of the pivot shaft portion and configured to support the bottom plate portion vertically; and mounting shaft portions bent from lower ends of the support shaft portions toward the fixed guides and connected to the fixed guides. The elevating frame is configured to be moved downward relative to the fixed frames as an angle between the bottom plate portion and the support shaft portions is decreased, and the elevating frame is supported at four or more points in all directions by the plurality of support bars. Each fixed frame has a vertical guide groove, and the elevating frame has a guide protrusion configured to be inserted into at least one vertical guide groove to guide vertical movement of the elevating frame. Each fixed guide has a support rib configured to support the elevating frame based on the elevating frame being moved downward. The elevating frame includes sidewall plate portions extending upward from both side ends of the bottom plate portion; and a shelf panel connected to upper ends of the sidewall plate portions and spaced upward apart from the bottom plate portion by a certain distance. The elevating frame defines a chiller chamber with the bottom plate portion, the sidewall plate portions, and the shelf panel. The refrigerator further includes a drawer configured to be pushed into or pulled out of the chiller chamber. The shelf panel is in contact with the evaporator based on the elevating frame being moved upward, and the expanded freezing compartment is defined between the evaporator and the shelf panel based on the elevating frame being moved downward. The shelf panel is charged with a cold storage material. The shelf panel is provided with a pivoting cover, and the pivoting cover is configured to pivot back and forth to open or close a front side of the expanded freezing compartment. The pivoting cover is configured to slide rearward along the shelf panel based on the elevating frame being moved upward. The evaporator includes an upper surface portion, a left side surface portion, and a right side surface portion, respectively defining an upper surface, a left side surface, and a right side surface of the freezing compartment. The evaporator further includes a rear surface portion defining a rear surface of the freezing compartment. The evaporator further includes a lower surface portion defining a lower surface of the freezing compartment, and the freezing compartment is defined as a fixed freezing compartment having a fixed capacity. The refrigerator further includes a freezing compartment door configured to open or close the fixed freezing compartment. The evaporator further includes a left extension and a right extension extending downward from the left side surface portion and the right side surface portion beyond the lower surface portion, and the left extension, the right extension, and the lower surface portion define the expanded freezing compartment based on the elevating frame being moved downward. The fixed frames are respectively provided with drain grooves, and the drain grooves are located below the left extension and the right extension such that defrosting water generated by the evaporator is introduced into the drain grooves. The elevating frame is provided at a rear portion of a drain groove such that defrosting water generated by the evaporator is introduced into the drain groove. The evaporator is a single plate, a rear surface portion of the evaporator is bent from a rear end of the lower surface portion, the upper surface portion is bent from an upper end of the rear surface portion, the left side surface portion is bent from a left end of the upper surface portion, and the right surface portion is bent from a right end of the upper surface portion. The lower surface portion is welded at left and right ends thereof to the left side surface portion and the right side surface portion to define the freezing compartment.

Another aspect of the subject matter described in this specification may be embodied in a refrigerator that includes a cabinet having a storage compartment; a door mounted to the cabinet configured to open or close at least a portion of the storage compartment; a freezing compartment defined in an upper region of the cabinet; a refrigerating compartment defined in a lower region of the cabinet; an evaporator configured to cool the freezing compartment; an elevating frame configured to define a chiller chamber between the freezing compartment and the refrigerating compartment, the elevating frame (1) provided at a lower part of the freezing compartment, (2) configured to move vertically, and (3) defining an expanded freezing compartment between the freezing compartment and the chiller chamber based on the elevating frame being moved downward; and fixed frames that are secured to respective sidewalls of the storage compartment and that are configured to guide and support vertical movement of the elevating frame.

Another aspect of the subject matter described in this specification may be embodied in a refrigerator that includes a cabinet having a storage compartment, the storage compartment being divided into a freezing compartment and a refrigerating compartment; a door mounted to the cabinet configured to open or close both the freezing compartment and the refrigerating compartment simultaneously; and a freezing compartment assembly provided in an upper region of the cabinet to define the freezing compartment separately from the refrigerating compartment, wherein the freezing compartment assembly includes an evaporator including an open front side, a left side surface portion, a right side surface portion, and a lower surface portion, the evaporator cooling the freezing compartment; an elevating frame provided below the lower surface portion, the elevating frame configured to move vertically and defining an expanded freezing compartment based on the elevating frame being moved downward; and fixed frames that are secured to respective sidewalls of the storage compartment and that are configured to guide and support vertical movement of the elevating frame, the fixed frames defining a space for vertical movement of the elevating frame therein. The evaporator further includes an upper surface portion and a lower surface portion, and the freezing compartment has a substantially cuboidal inner space such that a front side of the freezing compartment is open. The evaporator includes a left extension and a right extension extending downward from lower ends of the left side surface portion and the right side surface portion, and wherein the left extension and the right extension are connected respectively to the fixed frames provided in both sides of the storage compartment. Each fixed frame is provided on an upper surface of a drain groove, and the drain groove is configured to receive defrosting water introduced from the left extension or the right extension. The elevating fame includes a bottom plate portion extending from one fixed frame to the remaining fixed frame; a shelf plate spaced upward apart from the bottom plate portion configured to define a chiller chamber between the shelf plate and the bottom plate; a left sidewall plate portion and a right sidewall plate portion provided to connect both ends of the bottom plate portion and the shelf plate to each other; and a drawer configured to be pulled into or pushed out of the chiller chamber. The freezing compartment assembly further includes a support bar pivotably provided between the elevating frame and the fixed frames, the support bar having a support shaft portion configured to support the elevating frame while moving the elevating frame downward as an angle between the bottom plate portion and the support shaft portion is decreased from a right angle to a certain angle, the support shaft portion forming support points arranged to support at least four locations, including front and rear locations and left and right locations, of the elevating frame.

These and other embodiments may each optionally include one or more of the following features. For instance, variable adjustment of the size of a freezing compartment may be accomplished via movement of a partition wall between the freezing compartment and a refrigerating compartment.

In addition, defrosting water generated on an evaporator installed near the freezing compartment may be effectively drained so as to prevent the defrosting water from flowing to a drive device which moves the partition wall.

Moreover, the effective cooling of a variable freezing space as well as a fixed freezing space may be accomplished.

The details of one or more embodiments of the subject matter described in this specification are set forth in the accompanying drawings and the description below. Other potential features, aspects, and advantages of the subject matter will become apparent from the description, the drawings, and the claim.

DETAILED DESCRIPTION

Figure 1:
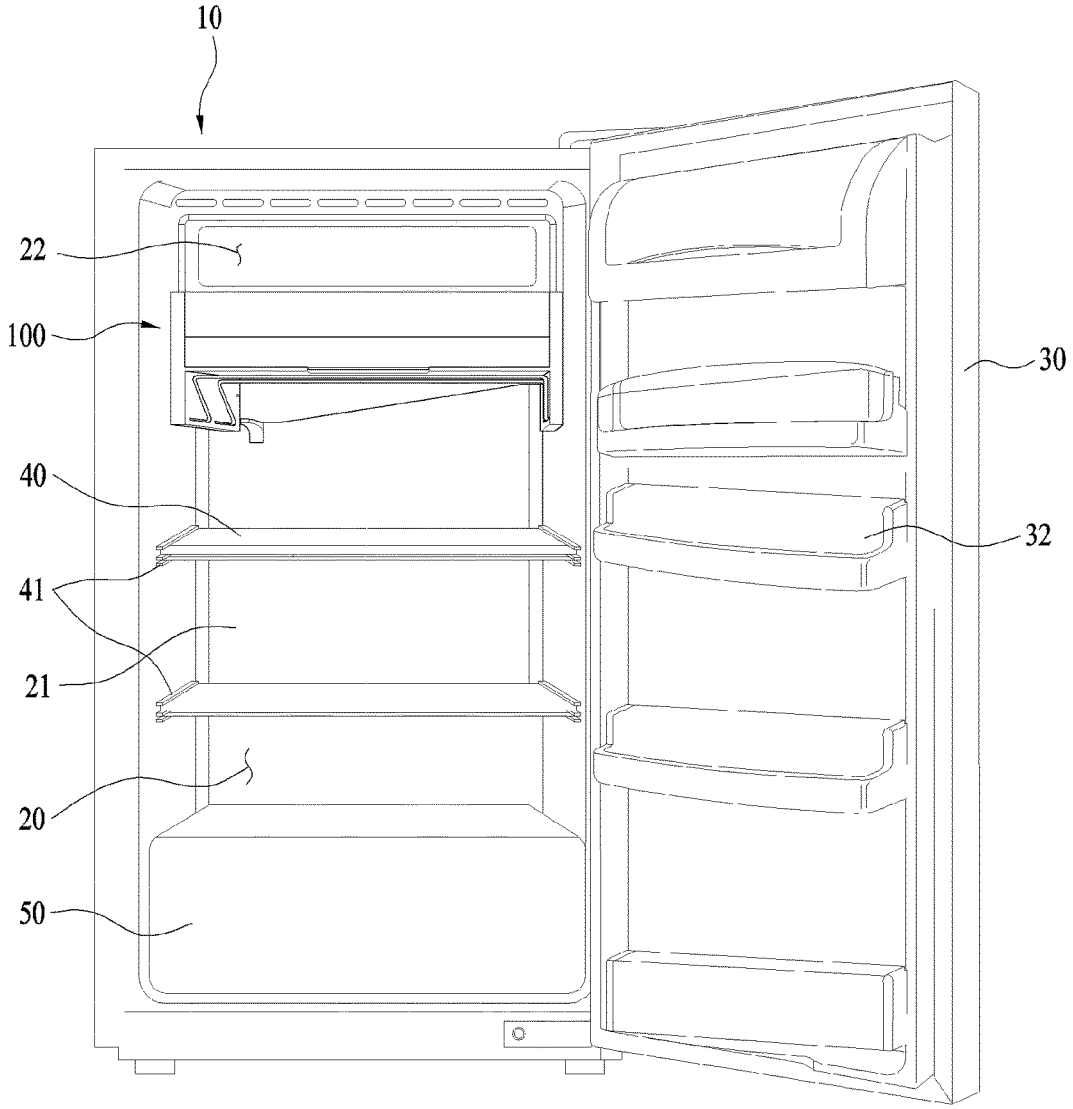
FIG. 1 is a diagram illustrating an example refrigerator.

FIG. 1 illustrates an example refrigerator. The refrigerator may include a freezing compartment 22 and a refrigerating compartment 21, which constitute a storage compartment 20 inside a cabinet 10. For example, the storage compartment 20, which is a single storage region defined by the cabinet 10, may be divided into the freezing compartment 22 and the refrigerating compartment 21. The freezing compartment 22 may be provided within a freezing compartment assembly 100. For example, the freezing compartment 22 may be separated from the refrigerating compartment 21 via the freezing compartment assembly 100 that is mounted in a partial region of the storage compartment 20.

A single door 30 may be pivotably mounted at one side of the cabinet 10 and serve to open or close the freezing compartment 22 and the refrigerating compartment 21. For example, by opening the single door 30, a user can access the freezing compartment 22 and the refrigerating compartment 21 in the storage compartment 20 which is a single storage region.

A plurality of baskets 32 having various shapes and sizes may be mounted to an inner surface of the door 30.

A shelf 40 may be provided in the refrigerating compartment 21, and the refrigerating compartment 21 may be divided into a plurality of sub storage regions by the shelf 40. For example, an upper region and a lower region may be separated by a shelf. In some implementations, the shelf 40 may be slidably supported by a shelf guide 41. When at least a part of the shelf 40 is removed, at least a part of the upper region and the lower region may be merged. Thus, a container, which is taller than one sub storage region, may be stored in the refrigerating compartment 21.

A drawer 50 may be provided in the lower section of the refrigerating compartment 21. In some implementations, the drawer 50 can be a part of the refrigerating compartment 21. The drawer 50 may be configured to define a space isolated from the remaining region of the refrigerating compartment 21, in order to prevent moisture evaporation. For example, the drawer 50 may be used to store vegetables or fruits.

The freezing compartment 22 may be provided in an upper region of the cabinet 10. In particular, the freezing compartment 22 may be provided in the upper region of the storage compartment 20 inside the cabinet 10.

The example refrigerator may be configured to increase or decrease a space in the freezing compartment 22 by controlling the volume of the freezing compartment 22. For example, the example refrigerator may increase the volume of the freezing compartment 22, beyond the basic volume of the freezing compartment 22, as needed. If the volume of the freezing compartment 22 increases, the volume of the refrigerating compartment 21 may be reduced. Thus, the freezing compartment assembly 100 may be configured to vary the storage space in the freezing compartment 22 by controlling the volume of the freezing compartment 22. In particular, this variation may be implemented via the upward/downward movement of a partition wall provided in the freezing compartment assembly 100.

The volume of the entire freezing compartment 22 may be changed by moving the partition wall vertically. For example, the freezing compartment 22 may have the minimum basic volume at the highest position, i.e. the default position at which the partition wall is moved upward to the maximum extent. Then, the volume of the freezing compartment 22 may be increased as the partition wall is moved downward. Once the partition wall has been moved downward to the maximum extent, the volume of the freezing compartment 22 may be increased to the maximum extent. On the other hand, the volume of the refrigerating compartment 21 may be minimized.

In some implementations, in the freezing compartment 22, an upper space may be a fixed space and a lower space may be a variable space defined by the vertically moving partition wall. In some other implementations, the space above a fixed partition wall may become a fixed freezing compartment space, and a variable freezing compartment space may be defined between the fixed partition wall and a vertically moving partition wall which is located below the fixed partition wall. For example, when the two partition walls are located so as to come into close contact with each other, the total space in the freezing compartment is minimized, and when the two partition walls are located farthest from each other, the variable space is maximized, i.e. the overall amount of space in the freezing compartment may become the maximum.

FIGS. 2 to 5 illustrate an example freezing compartment assembly 100. In the above description, for convenience of description, although a component, which separates the freezing compartment and the refrigerating compartment from each other, is named the partition wall, as will be described below, the partition wall may take the form of a singular component, or may take the form of plural components.

As described above, the space or volume of the freezing compartment may vary. As the space or volume of the freezing compartment varies, the space or volume of the refrigerating compartment varies. In some implementations, a freezing compartment may not be expandable. The freezing compartment can be fixed.

The freezing compartment 110, i.e. the basic freezing compartment 110 may define a cuboidal space, the front of which is open. Specifically, the basic freezing compartment 110 may be provided in a space inside an evaporator 200 which takes the form of a cuboid having an open front side. The freezing compartment 110, provided in the inner space defined by the evaporator 200, may be referred to as a freezing space having a fixed size or capacity. For example, the freezing compartment 110 can be defined as a fixed freezing compartment having a fixed size or capacity. In this case, although will be described below, both side surfaces and top and bottom surfaces of the freezing compartment 110 may be formed by the evaporator 200, and a rear surface of the freezing compartment 110 may also be formed by the evaporator 200. In addition, although the lower surface of the freezing compartment 110 may be formed by the evaporator 200, the lower surface of the freezing compartment 110 may be formed by any other component, instead of the evaporator 200.

A pair of fixed frames 300 may be installed underneath the freezing compartment 110. The fixed frames 300 are fixed to both sidewalls of the storage compartment.

Each of the fixed frames 300 may have at least two fastening holes 302, so as to be fastened and fixed to an inner side wall of the storage compartment via fastening members such as, for example, screws.

An elevating frame 400 may be provided at a lower part of the freezing compartment 110. In particular, the elevating frame 400 may be provided between the fixed frames 300. The freezing compartment space increases as the elevating frame 400 is moved downward. Although will be described below, the elevating frame 400 may define a storage space therein. The storage space may be an additional storage space provided between the freezing compartment and the refrigerating compartment. For example, the storage space may be maintained at a low temperature that falls in an intermediate range between the respective temperatures of the freezing compartment and the refrigerating compartment, and may be referred to as a chiller chamber.

The evaporator 200 may be fabricated by laying a refrigerant pipe between two metal plates and fusing the two plates to each other.

Although the evaporator 200 may be installed so as to be supported by the fixed frames 300 which are installed to both sidewalls of the storage compartment, the evaporator 200 may have at least two screwing holes 202 so as to be fastened to the ceiling surface and side surfaces of the storage compartment.

The freezing compartment 110 may generally have a cuboidal shape, and the evaporator 200 may have five surfaces, i.e. the fix surfaces of a cuboid excluding a front surface thereof.

A freezing compartment door 130 may be pivotably mounted to the front side of the freezing compartment 110. For example, in order to prevent cold air, inside the freezing compartment 110 of the storage compartment 20, from entering the refrigerating compartment 21, the freezing compartment door 130 may be provided. The freezing compartment door 130 may be a door operated after the main door 20 is opened.

For the mounting of the freezing compartment door 130, and consequently, for the opening or closing of the freezing compartment 110, a door frame 120 may be provided at the front surface of the evaporator 200. In addition, pivot shafts 123 may be provided at upper and lower ends of one side (e.g. a right side or a left side) of the door frame 120.

A handle 132 may be provided at the other side (e.g. a left side or a right side) of the freezing compartment door 130. The handle 132 may include a portion protruding from a front surface of the freezing compartment door 130 and a recess indented in the front surface. With the above-described configuration of the freezing compartment 110 and the freezing compartment door 130, the basic freezing compartment 110 may be acquired. For example, the effect of realizing a dual door refrigerator (i.e. a refrigerator in which a refrigerating compartment and a freezing compartment are separated from each other by a thermal insulation wall and are opened or closed by respective doors) may be acquired using a single door refrigerator (i.e. a refrigerator in which a refrigerating compartment and a freezing compartment are not separated from each other by a thermal insulation wall).

The elevating frame 400 may be vertically moved by a pair of support bars 500, which are pivotably connected between the fixed frames 300. In addition, the elevating frame 400 may be supported by the support bars 500.

The support bars 500 may be arranged back and forth. Each support bar 500 may extend from one fixed frames 300 to the other fixed frames 300. As such, at least four support points may be formed in different respective directions of the elevating frame 400 via the support bars 500.

Thus, the elevating frame 400 may move stably in vertical directions with the support of the support bars 500.

The support bars 500 are required to support the weight of the elevating frame 400 and stored items, and thus, may be formed of metal wires so as to achieve the sufficient strength thereof.

The elevating frame 400 may include a bottom plate portion 420. When the bottom plate portion 420 is moved downward, it may be said that, on the basis of the bottom plate portion 420, an upper space is expanded and a lower space is contracted. For example, a freezing compartment region can be expanded and a refrigerating compartment region can be contracted.

The elevating frame 400 may include a pair of sidewall plate portions 430, which extend upward from both side ends of the bottom plate portion 420. An additional storage space may be defined between the fixed freezing compartment 110, the bottom plate portion 420, and the sidewall plate portions 430. The storage space may be a chiller chamber 900. When the chiller chamber 900 defined by the elevating frame 400 is moved downward, the freezing space is increased. For example, although the simple vertical movement of the bottom plate portion 420 may be considered to vary the volume of the upper space and the lower space using a partition wall, the vertical movement of the chiller chamber 900 may be considered to vary the volume of the upper space and the lower space using a partition space.

In either case, when the elevating frame 400 is moved downward, the size of the variable freezing space is increased. When the elevating frame 400 is moved upward, the size of the variable freezing space is reduced, and correspondingly, a space in the refrigerating compartment 21 is increased.

Specifically, the support bars 500 may be pivotably mounted to a lower surface of the bottom plate portion 420 of the elevating frame 400 via bearings 540.

Each of the support bars 500 may include a pivot shaft portion 510 rotatably mounted to the elevating frame 400, support shaft portions 520 bent from both ends of the pivot shaft portion 510, and mounting portions 530 bent from lower ends of the support shaft portions 520 so as to extend toward the fixed frames 300. The pivot shaft portion 510 may be referred to as a horizontal shaft portion, and the support shaft portions 520 may be referred to as vertical shaft portions.

When an angle between the support shaft portion 520 and the bottom plate portion 420 is 90 degrees, the bottom plate portion 420 is located at the highest position at which it is moved upward to the maximum extent. In addition, the smaller the angle between the support shaft portion 520 and the bottom plate portion 420, the lower the height of the bottom plate portion 420.

Each bearing 540 serves to horizontally mount the pivot shaft portion 510. The bearing 540 may be fastened and fixed to the lower surface of the bottom plate portion 420 via two screws. As such, the bottom plate portion 420 is put on two wires which are spaced apart from each other in the front-and-rear direction and extend in the left-and-right direction. In addition, the bearing 540 may also serve to maintain the two pivot shaft portions 510 at a fixed front-and-rear distance.

The support bars 500 may be linked to each other. For example, the pivot shaft portions 510, which face each other at the front and rear sides of the elevating frame 400, may be rotated together. Specifically, all angles between the bottom plate portion 420 and the four support shaft portions 520 located on all sides of the bottom plate portion 420 may vary in the same manner. This is because it is desirable to allow the bottom plate portion 420 to be moved vertically while remaining horizontal.

Figure 5:
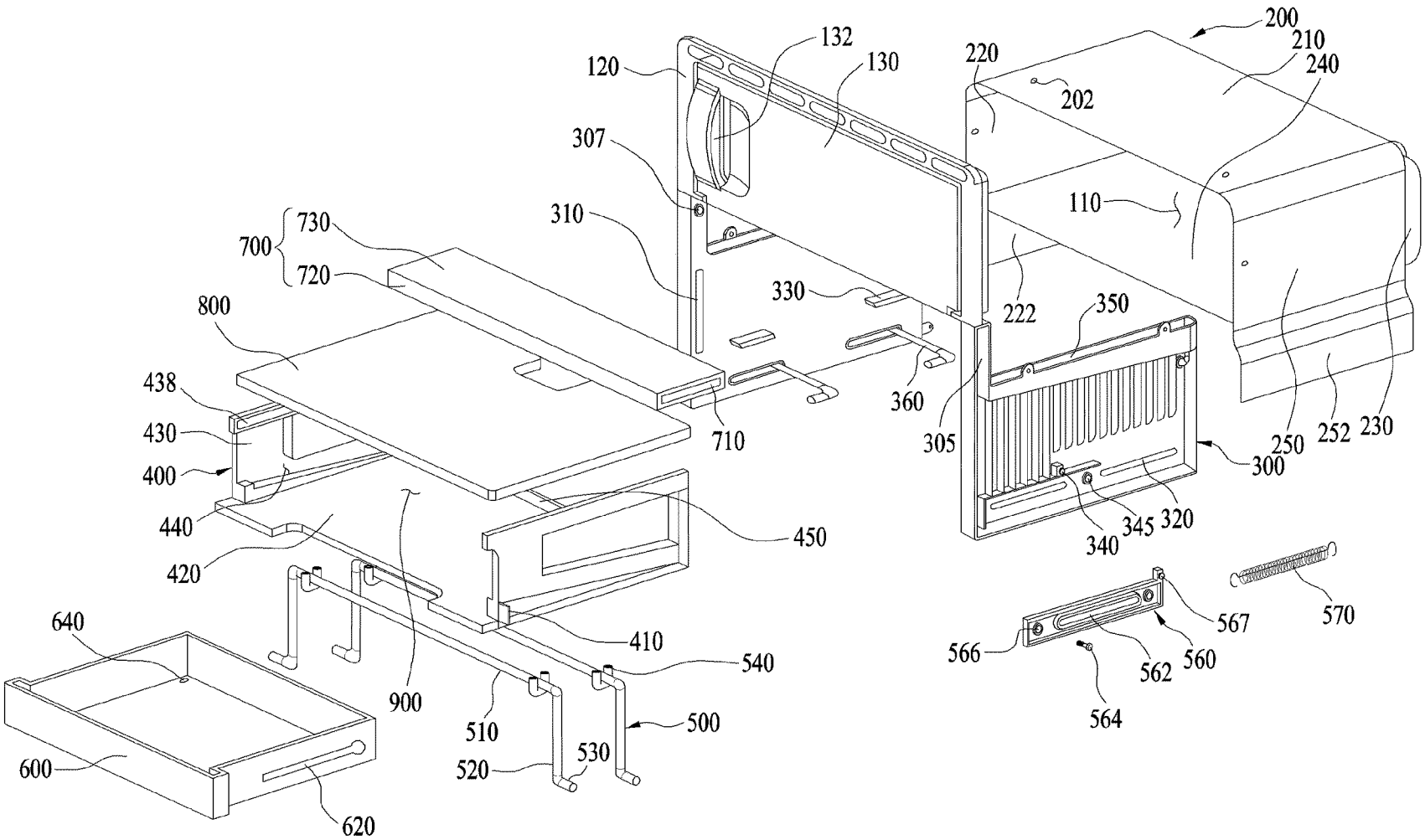

Referring to FIG. 5, the support bars 500 are connected to each other by a pair of left and right sliding bars 560. As such, the support bars 500 may be operated only when the sliding bars 560 are equally moved at the same time. For example, the bottom plate portion 420 may be vertically moved via back and forth movement of the sliding bars 560.

Specifically, each fixed frame 530 may have horizontal guide slots 320 formed in a lower portion thereof such that the two mounting shaft portions 530 are slidably inserted respectively. The horizontal guide slots 320 may be formed in the fixed frames 300 so as to extend in the front-and-rear direction. In addition, the horizontal guide slots 320 may be formed so as to allow penetration of the mounting shaft portions 530. As such, the mounting shaft portions 530 may slide back and forth along the horizontal guide slots 320.

The horizontal guide slots 320 may be formed in the lower portion of the fixed frames 300. In addition, there horizontal guide slots 320 may be two front and rear horizontal guide slots. The mounting shaft portion 530 of the front support bar 500 may slide in the front horizontal guide slot 320, and the mounting shaft portion 530 of the rear support bar 500 may slide in the rear horizontal guide slot 320.

The horizontal guide slots 320 may be formed respectively in both the fixed frames 300.

A length of each horizontal guide slot 320 may be determined in consideration of a length of the support shaft portion 520 of the support bar 500, a distance between the two pivot shaft portions 510, and a pivoting angle of the support bar 500 upon downward movement. For example, increasing the length of the horizontal guide slot 320 means that an angle between the bottom plate portion 420 and the support shaft portion 520 may be additionally reduced.

As described above, when the angle is 90 degrees, the bottom plate portion 420 may be at the highest position at which it is moved upward to the maximum extent. The bottom plate portion 420 is gradually moved downward as the angle is gradually reduced. At this time, the minimum angle may be 20 degrees or more. This is because it is very difficult to move the bottom plate portion 420 upward by applying force in the horizontal direction when the minimum angle is reduced to be less than 20 degrees. Accordingly, the length of the horizontal guide slot 320 may be determined such that the mounting shaft portion 530 is no longer moved when the angle reaches a predetermined minimum angle.

The sliding bars 560 may be provided at the respective fixed frames 300. The mounting shaft portion 530, having passed through the horizontal guide slot 320, may be connected to the sliding bar 560. The sliding bar 560 may be slidably mounted to an outer surface of the fixed frames 300. One sliding bar 560, i.e. the sliding bar 560 located at one side may be connected at front and rear ends thereof to the respective mounting shaft portions 530 so as to allow rotation of the mounting shaft portions 530.

The fixed frames 300 may be provided with a boss 345 at the center of a lower portion of the outer surface thereof, i.e. at a position between the two horizontal guide grooves 320, and the sliding bar 560 may be slidably mounted to the boss 345 as a screw 564 is fastened from the outer surface of the fixed frames 300 through an elongated hole 562 perforated in the sliding bar 560.

The sliding bar 560 may have shaft holes 566 at left and right sides of the elongated hole 562 such that the mounting shaft portions 530 are pivotably inserted into the shaft holes 566.

The sliding bar 560 may slide while being supported at three points by the screw 564, which is fastened through the elongated hole 562, and the two mounting shaft portions 530 which are inserted into the two shaft holes 566 and supported by the horizontal guide grooves 320. This is because the mounting shaft portions 530 are basically slidably supported by the horizontal guide grooves 320 of the fixed frames 300.

The sliding bars 560 may prevent the elevating frame 400 from tilting back and forth by allowing pivoting of the two support bars 500 to be synchronized such that the two support bars 500 pivot at the same angle.

In addition, the fixed frames 300 may further include vertical guide grooves 310 formed in a front portion of an inner surface thereof respectively. The elevating frame 400 may further include guide protrusions 410, which protrude from outer side surfaces thereof and are inserted into the respective vertical guide grooves 310 so as to be vertically moved.

The vertical guide grooves 310 may be vertically elongated in the front portion of the inner surface of the respective fixed frames 300, and the guide protrusions 410 may protrude laterally from the outer side surfaces of the elevating frame 400.

Although the support bars 500 are pivotably mounted to the elevating frame 400 and support the elevating frame 400, the provision of the pivoting support bars 500 may cause the elevating frame 400 to pivot, and thus, there is the possibility that the elevating frame 400 may be moved forward or rearward during vertical movement thereof. However, since the guide protrusions 410 of the elevating frame 400 are inserted into the vertical guide grooves 310 in the fixed frames 300 and are guided to be moved only in the vertical direction, the elevating frame 400 may be moved only in the vertical direction while remaining horizontal even when the support bars 500 pivot so as to move the elevating frame 400 vertically.

The fixed frames 300 may further include support ribs 330, which are formed at inner surfaces of the fixed frames 300 and serve to support the elevating frame 400 at a downwardly moved position thereof. For example, the support ribs 330 may support the bottom plate portion 420 when the bottom plate portion 420 is moved downward to the maximum extent.

Two support ribs 330 may protrude from an inner side surface of each fixed frames 300 so as to support the elevating frame 400 at the downwardly moved position thereof.

If the support ribs 330 protrude to an excessively long length, the support ribs 300 can interfere with objects received in the refrigerating compartment 21. Therefore, the support ribs 330 may have a thickness and length suitable for achieving a desired strength.

Meanwhile, a tensile spring 570 may be connected between one end of the sliding bar 560 and the outer side surface of the fixed frames 300.

One end of the tensile spring 570 may be connected to a spring mounting protrusion 340 formed at the outer side surface of the fixed frames 300, and the other end of the tensile spring 570 may be connected to one end of the sliding bar 560, for example, a spring mounting protrusion 567 which protrudes upward from a rear end of an upper surface of the sliding bar 560.

Figure 2:
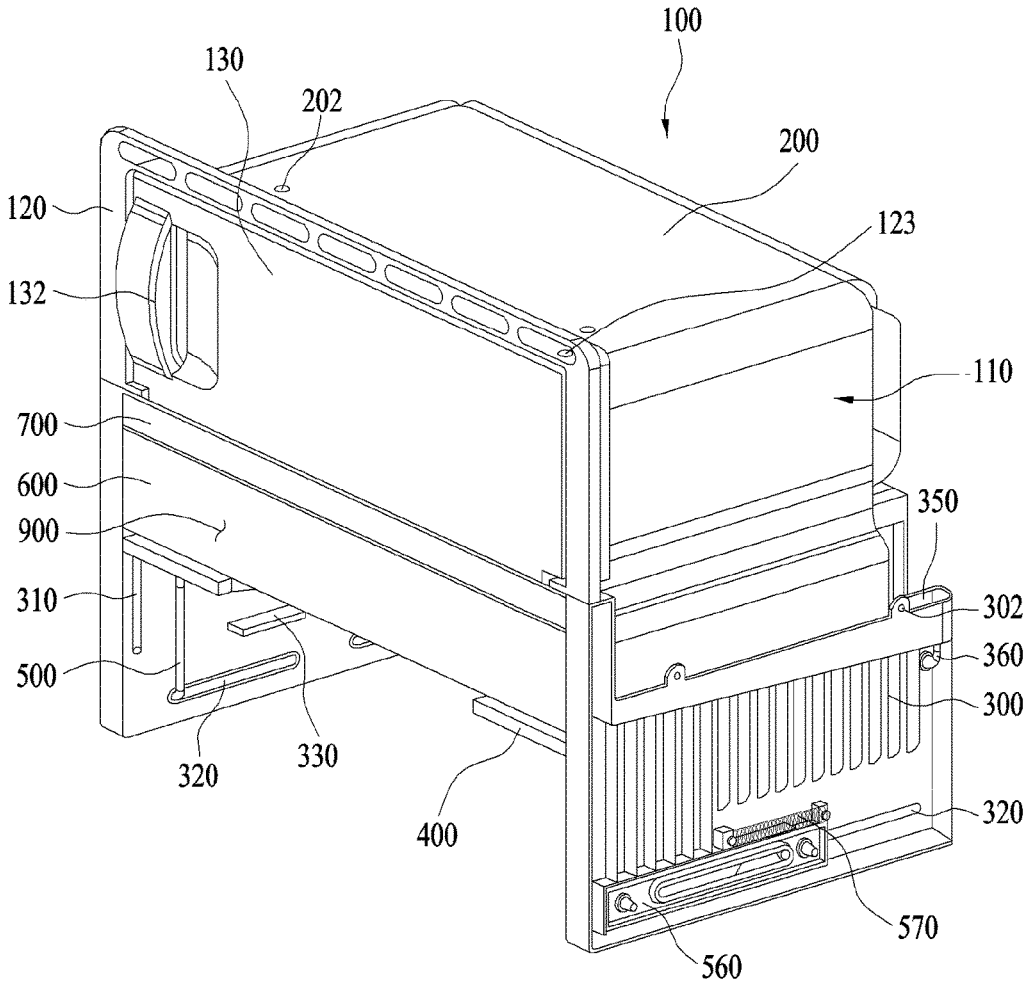
FIGS. 2 to 6B are diagrams illustrating an example freezing compartment assembly.
Figure 3:
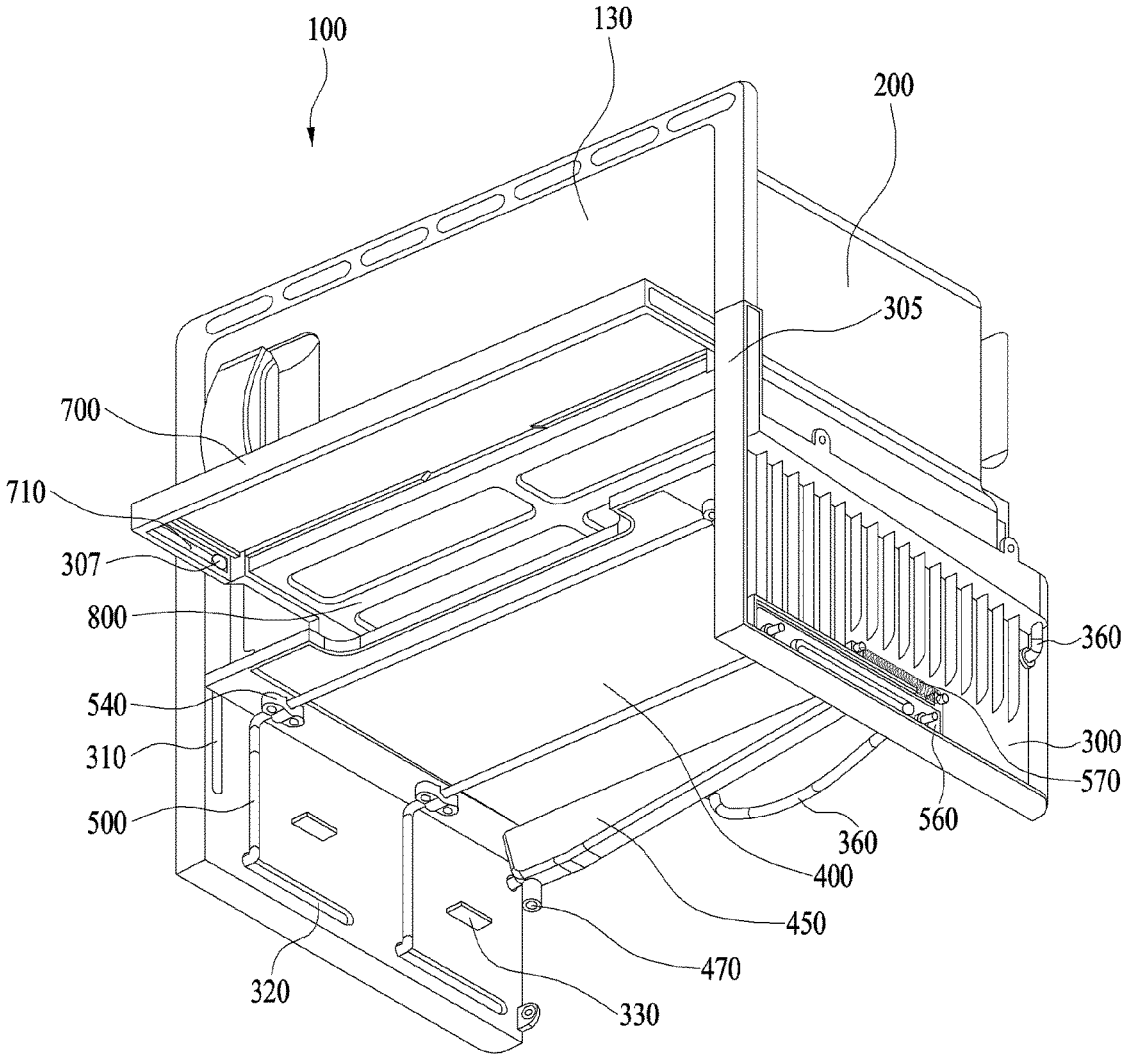
Figure 4:
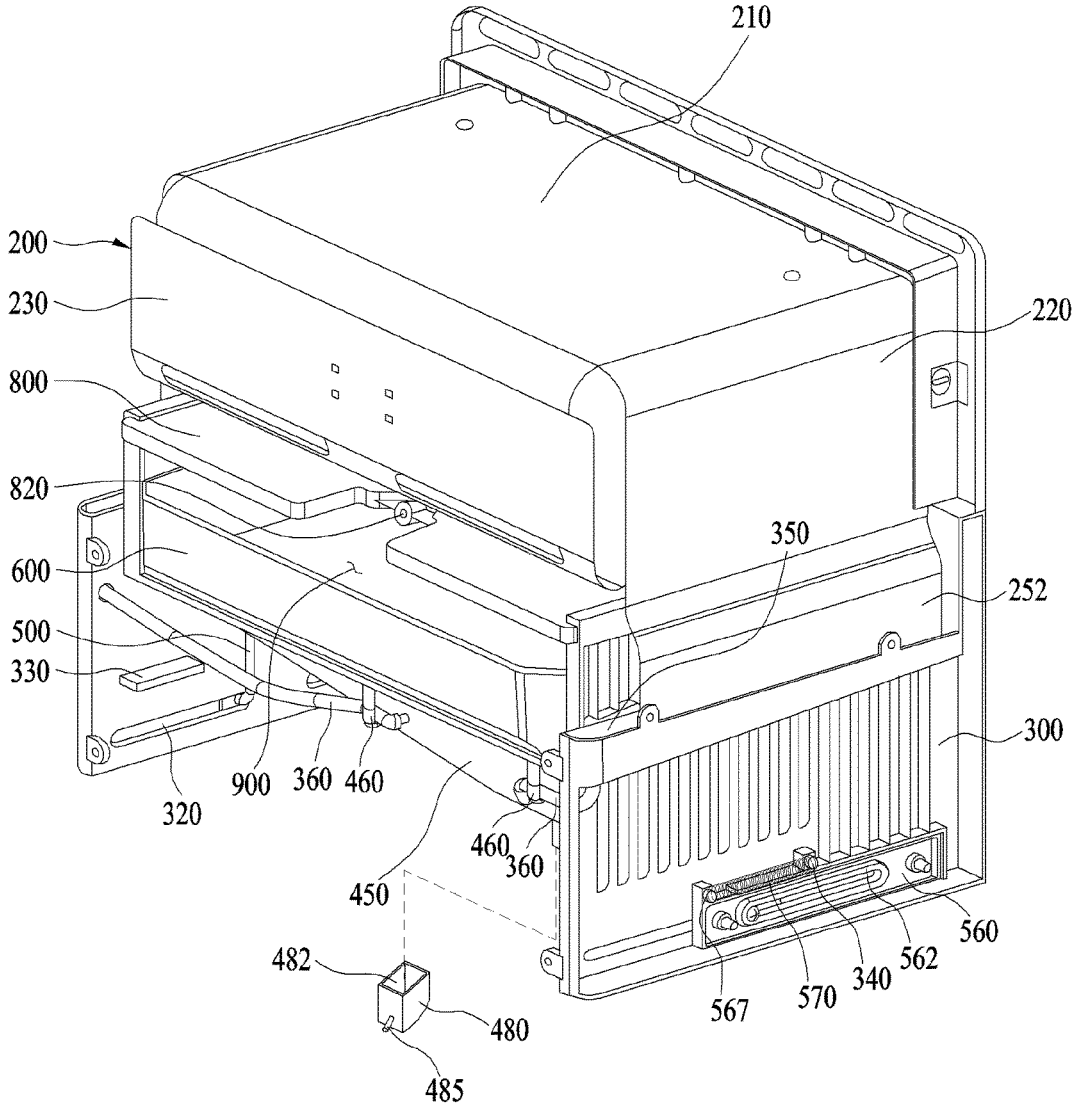

Referring to FIGS. 2 to 4, while the elevating frame 400 is at the upwardly moved position, the tensile spring 570 applies elastic force required to pull the sliding bar 560 forward.

For example, as the mounting shaft portions 530 are inserted into the two shaft holes 566 of the sliding bar 560, the tensile spring 570 applies elastic force to the mounting shaft portions 530 forward.

As such, even if the support bars 550 are slightly pushed or receive shocks in a state in which the support shaft portions 520 of the support bars 550 are substantially upright, the support bars 500 may not easily pivot and remain to support the elevating frame 400.

Figure 6A:
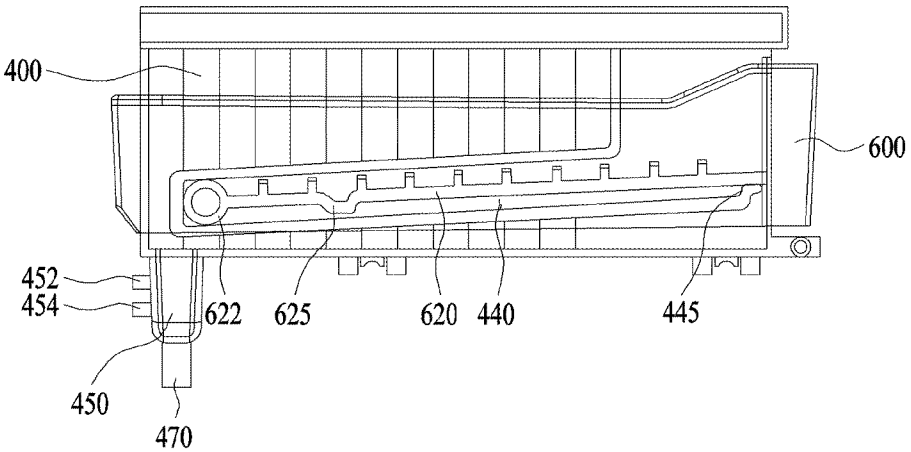
Figure 6B:
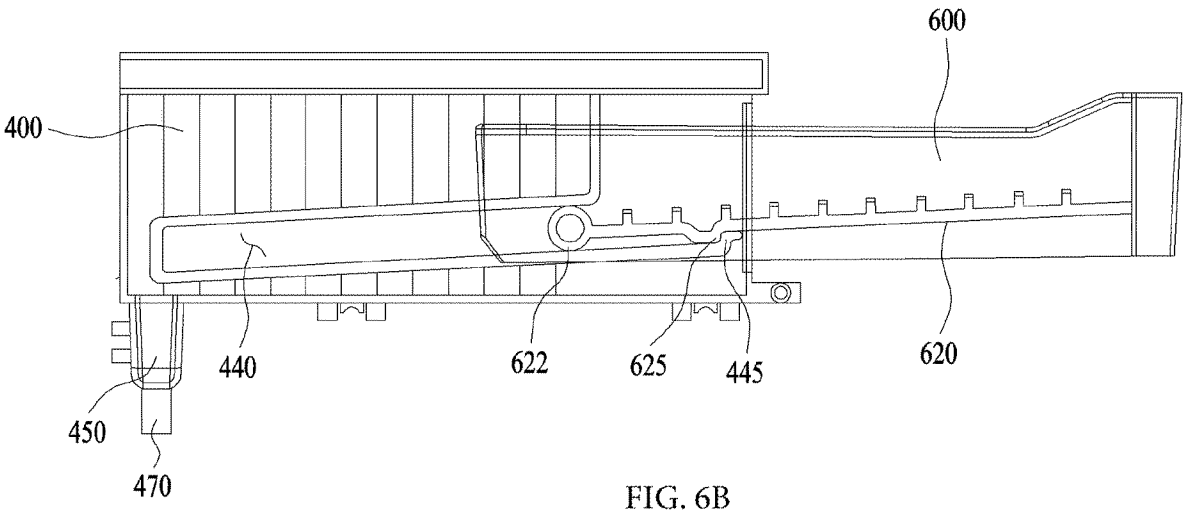

Referring to FIGS. 5 to 6B, the elevating frame 400 may define an additional storage space. For example, the chiller chamber 900 may be defined between the basic freezing compartment 110 and the refrigerating compartment 21. A drawer 600 may be mounted inside the elevating frame 400 so as to be pulled out. The user can use the chiller chamber 900 via the drawer 600.

The drawer 600 may be provided with a grip recess (610, see FIGS. 10A and 10B) indented upward from a lower end of a front surface thereof.

The drawer 600 may include guide ribs 620 which protrude from outer side surfaces thereof, and the elevating frame 400 may further include guide grooves 440 which are formed in inner surfaces of the sidewall plate portions 430 and serve to guide the guide ribs 620 of the drawer 600 inserted thereinto.

The front surface of the drawer 600 may have a greater width than a width between both side surfaces of the drawer 600 and may be configured to close the open front side of the elevating frame 400 so as to define a hermetically sealed storage space.

The guide ribs 620 may be inclined so as to be gradually reduced in height rearward relative to a bottom surface of the drawer 600. Correspondingly, the guide grooves 440 may be inclined so as to be gradually reduced in height rearward. In this way, the user may smoothly push the drawer 600 inward with low force.

In addition, referring to FIGS. 6A and 6B, each guide groove 440 may be provided at a front end thereof with a stepped portion 445, and each guide rib 620 may be provided at a rear lower portion thereof with a protruding stopper 625.

The guide rib 620 may be integrally formed at a rear end thereof with a contact protrusion 622, which has a circular shape when viewed from the outer lateral side.

As such, a bottom surface of the guide groove 440 may come into contact with only lower surfaces of the circular contact protrusion 622 and the protruding stopper 625, rather than coming into contact with the entire lower surface of the guide rib 620. This may reduce a sliding contact area between the guide rib 620 and the guide groove 440, which may reduce friction and ensure smooth sliding.

When the user pulls the drawer 600 out, the drawer 600 is pulled out only until the protruding stopper 625 is caught by the stepped portion 445, which may limit the length of the drawer 600 that the drawer 600 can be pulled out to the maximum extent.

At any time while the drawer 600 is being pulled out, the contact protrusion 622, which has been in contact with the lower surface of the guide groove 440, may come into contact with an upper surface of the guide groove 440 so as to slide on the upper surface. In this case, downward rotational moment is applied to a portion of the drawer 600 that is in front of the stepped portion 445.

When the drawer 600 is pulled out to the end, in particular, there is the risk of the drawer 600 falling out along with the items received therein. Therefore, by allowing the protruding stopper 625 to be caught by the stepped portion 445, the distance that the drawer 600 can be pulled out is limited, which may ensure that the drawer 600 is stably supported by the guide groove 440 and may prevent the drawer 600 from falling out.

To completely remove the drawer 600 for cleaning, etc., the drawer 600 may be completely separated from the elevating frame 400 by being pulled in a state in which the front half of the drawer 600 is lifted slightly.

Accordingly, in this example, the elevating frame 400 enables the expansion of the freezing space as well as the formation of the chiller chamber 900. In conclusion, it can be appreciated that the freezing space may vary via vertical movement of the entire chiller chamber 900.

Meanwhile, the chiller chamber 900 should be isolated from the remainder of the space so as to define a somewhat hermetically sealed space. As described above, the front side of the chiller chamber 900 may be hermetically sealed by the front surface of the drawer 600. Hereinafter, a configuration of the chiller chamber 900 defined by the elevating frame 400 will be described in detail.

Referring to FIGS. 3 and 5, the elevating frame 400 may further include a shelf panel 800 disposed on the sidewall plate portions 430. For example, the shelf panel 800 may be spaced upward apart from the bottom plate portion 420 by a predetermined distance. As such, the shelf panel 800 functions as an upper surface of the chiller chamber 900, and the bottom plate portion 420 functions as a lower surface of the chiller chamber 900.

In addition, the sidewall plate portions 430 may extend upward from both ends of the bottom plate portion 420 and be connected to the shelf panel 800. As such, the respective sidewall plate portions 430 function as both side surfaces of the chiller chamber 900. In addition, it will be appreciated that a rear surface of the chiller chamber 900 is formed by a rear wall of the storage space defined by the cabinet.

The shelf panel 800 can be a rectangular panel having a predetermined thickness. To mount the shelf panel 800, panel mounting grooves 438 may be formed respectively in the top of the sidewall plate portions 430.

The shelf panel 800 may internally define a space and a cold storage material formed of a phase change material may be introduced into the space. For example, the shelf panel 800 may include a cold storage pack.

Referring to FIG. 4, the shelf panel 800 may be provided at the rear center thereof with an injection port 820 to enable injection of the cold storage material.

The phase change material may be a material that cools the surrounding air by melting from a frozen solid into a liquid via heat exchange with the surrounding air and that may have high heat of fusion. For example, the phase change material may be a material or a structure that is changed into a solid by absorbing cold air from the evaporator 200 in a normal state (i.e. when power is applied), and subsequently emits the absorbed cold air in an emergency state (i.e. a blackout). Accordingly, because a portion of the chiller chamber 900 is formed using the cold storage material, the chiller chamber 900 may be provided as a space that provides protection in the event of a blackout.

In some implementations, storage items, which must be continuously stored at a low temperature and which may easily spoil when the temperature rises, may be stored in the chiller chamber 900. This is because the temperature of the freezing compartment or the refrigerating compartment may increase relatively steeply in the event of a blackout. However, the chiller chamber 900 may perform a function of maintaining a somewhat low temperature even in a blackout because it is separated from the remainder of the storage space and is partially formed of the cold storage material.

The shelf panel 800 may be provided to form the upper surface of the chiller chamber 900. In addition, the shelf panel 800 may be configured to come into contact with a lower surface portion 240 of the evaporator 200. For example, the shelf panel 800 may come into contact with the evaporator 200 at the underside of the lower portion 240. This state may be referred to as a state in which the elevating frame 400 is moved to the highest height.

Once the evaporator 200 and the shelf panel 800 come into contact with each other, the cold storage material may more effectively absorb cold air. Contrary, upon blackout, the cold storage material may effectively resupply the cold air to the evaporator 200. With this shelf panel 800, the supply of cold air is performed even upon a blackout, and an additional chiller chamber may be effectively implemented.

For example, as the entire storage compartment 200 inside the cabinet 10 is provided with the evaporator 200, i.e. a single cooler, the freezing compartment 110 may be kept within a temperature range from −18° C. to 9° C., the chiller chamber 900 may be kept within a temperature range from −1° C. to 8° C., and the refrigerating compartment 21 may be kept within a temperature range from 1° C. to 4° C.

Referring to FIG. 2, the freezing compartment door 130 may be pivotably mounted to a front opening of the freezing compartment 110.

To this end, the door frame 120 may be fastened to the front rim portion of the evaporator 200.

As exemplarily illustrated in FIG. 4, the door frame 120 may be provided at side surfaces thereof with fastening holes for screwing with the evaporator 200.

The door frame 120 may be supported by upper ends of the sidewall plate portions 430, and a front surface of the door frame 120 may define the same plane as front surfaces of the sidewall plate portions 430.

The door frame 120 may extend rearward so as to surround the front rim portion of the evaporator 200, the pivot shafts 123 of the freezing compartment door 130 may be inserted into upper and lower portions of the right side of the extended portion of the door frame 120.

Meanwhile, at the lowest position at which the elevating plate 400 is moved downward to the maximum extent, an expanded freezing compartment may be defined above the elevating frame 400. The expanded freezing compartment may be separated from the remaining storage space. For example, the expanded freezing compartment may be formed as a hermetically sealed storage space.

Hereinafter, a configuration of the expanded freezing compartment will be described in detail.

A pivoting cover 700 may be mounted to an upper end of the fixed frames 300 so as be vertically pivotable, and may close a front opening of the expanded freezing compartment when the elevating frame 400 is moved downward. For example, the pivoting cover 700 may be mounted to both the fixed frames 300.

Specifically, the pivoting cover 700 may be provided to the front opening between a lower end of the freezing compartment door 130 and the shelf panel 800.

Referring to FIG. 3, the pivoting cover 700 may be pivotably and slidably mounted to pivot shafts 307, which are provided at extensions 305 extending upward from an upper surface of the front end of the respective sidewall plate portions 430. The pivoting cover 700 may be provided at both side surfaces thereof with pivot shaft recesses 710, into which the pivot shafts 307 are slidably inserted.

Referring to FIG. 5, the pivoting cover 700 may include a front surface portion 720 configured to cover a front surface of the shelf panel 800 when the elevating frame 400 is moved upward, and an upper surface portion 730 configured to cover a front opening between a lower end of the freezing compartment door 130 and the shelf panel 800 when the elevating frame 400 is moved downward.

The pivoting cover 700 may slide rearward in the horizontal state when the elevating frame 400 is moved upward. Thereafter, the front surface portion 720 of the pivoting cover 700 may cover a front surface of the shelf panel 800, and thus prevent deterioration in aesthetic external appearance caused when the shelf panel 800 is exposed.

In addition, the pivoting cover 700 may slide forward in the horizontal state when the elevating frame 400 is moved downward. Thereafter, the pivoting cover 700 may be rotated downward by the weight thereof. With this rotation, the pivoting cover 700 may cover the front opening between the lower end of the freezing compartment door 130 and the shelf panel 800, thereby hermetically sealing the expanded freezing compartment so as to be separated from the refrigerating compartment 21 and the basic freezing compartment 110.

Accordingly, an upper surface of the expanded freezing compartment may be formed by the upper surface portion 210 of the evaporator 200, and a lower surface of the expanded freezing compartment may be formed by the shelf panel 800. Of course, a rear surface of the expanded freezing compartment may be formed by the rear wall of the cabinet. Accordingly, the expanded freezing compartment may be referred to as a storage space into which cold air is directly supplied by the evaporator 200. In addition, the expanded freezing compartment may be referred to as a storage space into which cold air is directly supplied by the cold storage material.

Meanwhile, both side surfaces of the expanded freezing compartment may be formed by the evaporator 200. Accordingly, at least three surfaces of the expanded freezing compartment may be surfaces to which cold air is directly supplied from the evaporator 200. In addition, at least one surface of the expanded freezing compartment may be a surface to which cold air is directly supplied from the cold storage material. Accordingly, instead of a general evaporator configuration, a new evaporator configuration may be provided.

The elevating frame 400 described above is configured to be moved upward or downward relative to the fixed frames 300. Refrigerators are characterized in that ice or frost may be generated after moisture condenses near the freezing compartment. This ice or frost may restrict the vertical movement of the elevating frame 400. Thus, there is a demand for a new evaporator configuration or a new configuration to prevent the generation of ice or frost.

Hereinafter, in addition to a new evaporator configuration, a configuration to effectively remove defrosting water generated on the evaporator 200 will be described in detail. The evaporator configuration and the defrosting water removal configuration may be implemented in the freezing compartment assembly.

Referring to FIG. 5, the evaporator 200 may include the upper surface portion 210, a left side surface portion 220, a rear side surface portion 230, a lower surface portion 240, and a right surface portion 250, which respectively form an upper surface, a left surface, a rear surface, a lower surface, a right surface, and an upper surface of the freezing compartment 110. Accordingly, it will be appreciated that at least five surfaces of the freezing compartment 110 may be formed by the evaporator 200.

The evaporator 200 may further include a pair of extensions 222 and 252, which extend downward from lower ends of the left side surface portion 220 and the right surface portion 250. The extensions 222 and 252 may correspond to a left surface and a right surface of the chiller chamber 900. As such, the chiller chamber 900 is surrounded by the lower surface portion 240 and the extensions 222 and 252 of the evaporator 200. In this way, it is possible to very effectively cool the interior of the chiller chamber 900.

Meanwhile, the extensions 222 and 252 may form a left surface and a right surface of the expanded freezing compartment when the chiller chamber 900 is moved downward, i.e. when the freezing compartment is expanded. Accordingly, even the interior of the expanded freezing compartment may be effectively cooled. This is because, at this time, the extensions 222 and 252 may directly cool the expanded freezing compartment.

The evaporator 200 may cool air inside the freezing compartment 110 defined therein, and the lower surface portion 240 and the extensions 222 and 252 cool air below the lower surface portion 240. In this way, cold air may also be effectively supplied into the refrigerating compartment.

A detailed configuration of the evaporator 200 and the flow of refrigerant will be described below.

Referring to FIGS. 2 and 4, each fixed frames 300 may further include a drain groove 350, which is formed in an upper surface of the fixed frames 300 and accommodates defrosting water generated from the evaporator 200. The drain groove 350 may serve to remove defrosting water as soon as the defrosting water is generated on the evaporator 200.

Ice may be generated between peripheral components when the defrosting water is not removed and thus freezes, thereby constraining the components. As described above, when ice is generated between the elevating frame 400 and the evaporator 200, movement of the elevating frame 400 may be limited. Thus, the user cannot easily vary the freezing space. In addition, when the user attempts to vary the freezing space by force, there is the risk of damage to, for example, the evaporator 200 or the elevating frame 400. Accordingly, it will be appreciated that the removal of defrosting water is very important in regard to vertical movement of the elevating frame 400.

In this example, defrosting water generated from the evaporator 200 may be very effectively removed. In particular, this very effective removal of defrosting water may be accomplished by allowing the defrosting water to flow down along the extensions 222 and 252 which take the form of plates extending downward from the left and right sides of the evaporator 200.

In particular, lower ends of the extensions 222 and 252 of the evaporator 200 may be located inside the drain grooves 350 so that the defrosting water flowing on inner and outer surfaces of the extensions 222 and 252 is introduced into the drain grooves 350. For example, the extensions 222 and 252 may extend to central portions of the drain grooves 350, rather than coming into contact with sidewalls of the drain grooves 350. In this way, the defrosting water flowing on the inner and outer surfaces of the extensions 222 and 252 may be effectively introduced only into the drain grooves 350, without a risk of flowing out of the drain grooves 350.

The drain grooves 350 may be elongated in the front-and-rear direction on the top of the fixed frames 300, and may have a prescribed width in the left-and-right direction.

Since the lower ends of the extensions 222 and 252 are mounted so as to be located at the center of the drain grooves 350, the defrosting water flowing on outer side surfaces of the evaporator 200 as well as the defrosting water flowing on a lower surface of the lower surface portion 240 and inner side surfaces of the extensions 222 and 252 may be introduced into the drain grooves 350.

In addition, the lower surface of the lower surface portion 240 of the evaporator 200 may have a higher central portion and may be gradually reduced in height leftward and rightward.

As such, the defrosting water generated on the lower surface of the lower surface portion 240 may also smoothly flow to the extensions 222 and 252.

The bottom of the drain groove 350 of the fixed frames 300 may be inclined so as to be gradually reduced in height rearward.

Consequently, the defrosting water introduced into the drain groove 350 may flow to a rear end of the drain groove 350 so as to be discharged through a drain hole 470 which is formed at the lowermost position.

Referring to FIGS. 3 to 5, the bottom plate portion 420 of the elevating frame 400 may be inclined such that a bottom surface thereof is gradually reduced in height rearward, and a drain groove 450 may be formed in a lower end of the bottom plate portion 420 so as to extend lengthwise in the left-and-right direction. The drain groove 450 is formed in the elevating frame 400, and thus differs from the drain groove 350 formed in the fixed frames 300 described above. The drain groove 450 may be referred to as a rear drain groove, and the drain groove 350 may be referred to as a lateral drain groove.

The shelf panel 800 may also cause the generation of defrosting water because it cools the surrounding air to a temperature below zero degrees via the cold storage material introduced therein. When the defrosting water changes into ice, there is the risk of the shelf panel 800 becoming stuck to the evaporator 200. The shelf panel 800 is required to be moved downward from the evaporator 200 in order to expand the freezing space. Thus, expansion of the freezing space may be limited by the defrosting water.

The defrosting water generated on the shelf panel 800 falls onto the bottom plate portion 420 of the elevating frame 400. The fallen defrosting water will flow rearward because the bottom surface of the bottom plate portion 420 is inclined rearward.

Since the drain groove 450 is formed at the rear end of the bottom plate portion 420 to extend lengthwise in the left-and-right direction, the defrosting water on the bottom surface may be introduced into the drain groove 450.

The drain groove 450 may have an inclined bottom surface, and the drain hole 470 may be formed at the lowermost position of the bottom surface.

The drain groove 450 may be inclined so as to be gradually reduced in height leftward when viewed from the front side as in FIG. 3.

Meanwhile, as described above, when the drawer 600 is mounted to the elevating frame 400, the defrosting water falls from the shelf panel 800 to the drawer 600.

As such, the drawer 600 may have a drain hole 640 formed in a bottom surface thereof.

The drain hole 640 may be formed at a position corresponding to the drain hole 470 of the bottom plate portion 420.

The bottom surface of the drawer 600 may be inclined to allow the defrosting water to flow to the drain hole 640.

The defrosting water that falls to the drawer 600 flows to the drain hole 640, thereby falling to the drain groove 450 of the bottom plate portion 420, and subsequently falling through the drain hole 470.

A hose 360 may be connected to allow the defrosting water to move from the drain groove 350 of the fixed frames 300 to the drain groove 450 of the elevating frame 400.

The hose 360 may be formed of a synthetic resin material so as to be flexible because the elevating frame 400 is vertically moved relative to the fixed frames 300.

A distance between both connection ends of the hose 360 may become farthest when the elevating frame 400 is moved downward, and a length of the hose 360 may be slightly longer than the farthest distance.

Since the hose 360 is stretchable, the drain groove 450 in the elevating frame 400 may be provided at a rear surface thereof with a hook 460 such that the hose 360 is hung and fixed to the hook 460.

A water sump 480 may be installed below the drain hole 470 and may receive water from the drain hole 470 to allow the water to pass through the rear wall of the cabinet 10.

Referring to FIG. 4, the water sump 480 may include a top opening 482 and an extension tube 485 which extends rearward and downward from a rear wall thereof so as to penetrate the rear wall of the cabinet 10.

The top opening 482 may have a prescribed area or more to ensure that all of the water falling from the drain hole 470 is introduced into the top opening 482 even when the elevating frame 400 is at the upwardly moved position.

The water sump 480 is mounted inside the rear wall of the storage compartment of the cabinet 10, and even when the elevating frame 400 is at the downwardly moved position, the water sump 480 may be located below the drain hole 470 so as not to interfere with the drain hole 470.

A lower end of the drain hole 470 may be introduced into the opening 482 so long as the drain hole 470 and the water sump 480 do not interfere with each other.

Next, a detailed configuration of the direct cooling type evaporator will be described below.

Figure 7:
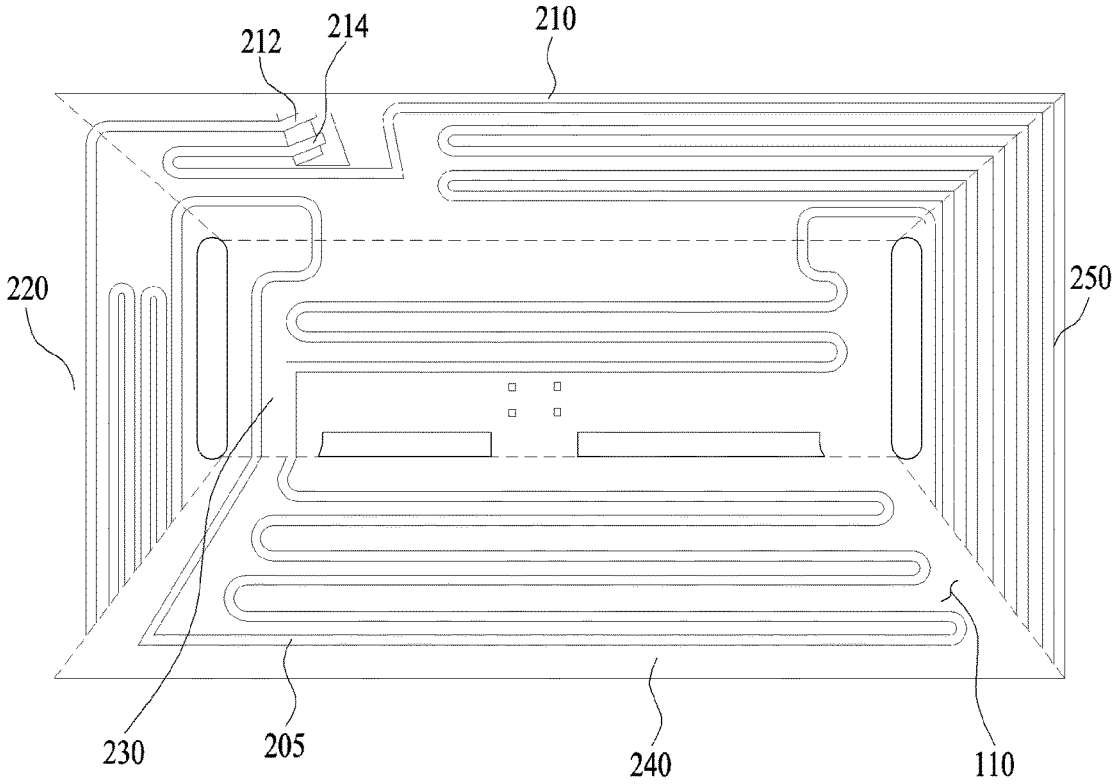
FIG. 7 is a diagram illustrating example refrigerant pipes in an evaporator.
Figure 8:
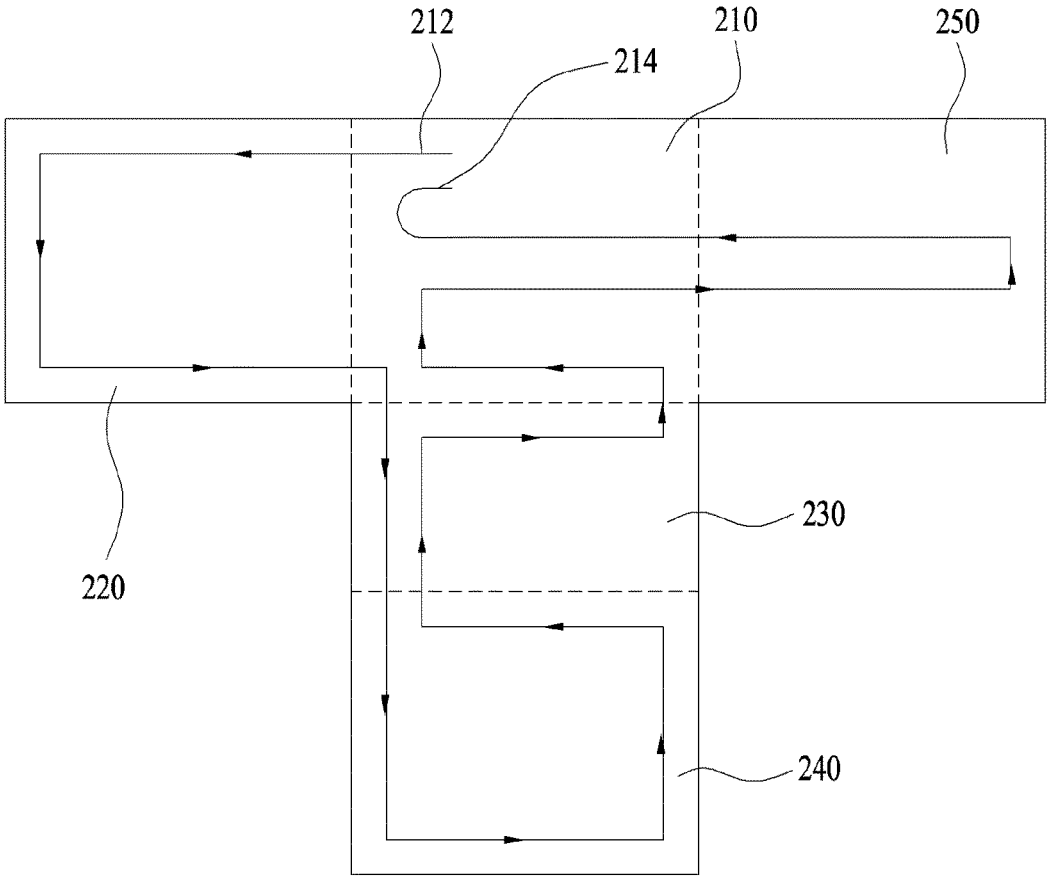
FIG. 8 is a diagram illustrating an example flow of refrigerant in the evaporator.

Referring to FIGS. 5, 7 and 8, the evaporator 200 includes the lower surface portion 240, the rear surface portion 230 bent from a rear end of the lower surface portion 240, the upper surface portion 210 bent from an upper end of the rear surface portion 230, the left side surface portion 220 bent from a left end of the upper surface portion 210, and the right side surface portion 250 bent from a right end of the upper surface portion 210.

FIG. 7 illustrates an example freezing compartment 110 defined in the evaporator 200 of FIG. 5.

The evaporator 200 may be a cuboid consisting of an open front surface, the upper surface portion 210, the left side surface portion 220, the rear surface portion 230, the lower surface portion 240, and the right side surface portion 250.

The rear surface portion 230 is connected to the upper surface portion 210, the left side surface portion 220, the lower surface portion 240, and the right side surface portion 250, and bent portions are shown by dotted lines in FIG. 7.

On the other hand, provided between the lower surface portion 240 and the left side surface portion 220 and between the lower surface portion 240 and the right side surface portion 250 are welds for the connection of separate plates, rather than bent portions being provided therebetween. In FIG. 7, corners thereof are shown by solid lines.

The evaporator 200 can be fabricated by inserting a refrigerant pipe between two metal plates and fusing the metal plates to each other.

Thus, the fabricated evaporator 200 takes the form of a plate having a prescribed plane shape as the refrigerant pipe is appropriately arranged between the two metal plates and the two metal plates are fused to each other.

The evaporator 200 may be formed into a plate having a shape as shown in the planar figure of FIG. 8.

The left side surface portion 220 and the right side surface portion 250 may be connected to the left and right sides of the upper surface portion 210, the rear surface portion 230 may be connected to the underside of the upper surface portion 210, and the lower surface portion 240 may be connected to the underside of the rear surface portion 230.

The evaporator 200 may further include the extensions 222 and 252, which extend downward from the lower surface portion 240 from lower ends of the left side surface portion 220 and the right side surface portion 250.

In FIG. 8, the rear surface portion 230 is folded from a rear end of the lower surface portion 240 so as to form the rear surface, and the upper surface portion 210 is folded from an upper end of the rear surface portion 230 so as to form the upper surface.

The left side surface portion 220 and the right side surface portion 250 are folded from left and right side ends of the upper surface portion 210 so as to form the left side surface and the right side surface. A vertical length of the folded left and right side surface portions 220 and 230 is greater than a height of the rear surface portion 230.

As such, the extensions 222 and 252 are formed as the left side surface portion 220 and the right side surface portion 250 extend further downward than the lower surface portion 240 due to the fact that the height thereof is longer than the height of the rear surface portion 230.

Referring to FIG. 7, the evaporator 200 may have a refrigerant inlet 212 and a refrigerant outlet 214 formed in the upper surface portion 210.

A portion of the upper surface portion 210, in which the refrigerant inlet 212 and the refrigerant outlet 214 are present, may be cut into a "ㄷ" -shaped portion and be bent upward.

As such, the refrigerant inlet 212 and the refrigerant outlet 214 may be connected to a refrigerant pipe located at the outside of the evaporator 200.

The refrigerant pipe inside the evaporator 200 may be arranged in such a way that refrigerant moves from the refrigerant inlet 212 in the upper surface portion 210 to the left side surface portion 220, subsequently moves to the rear surface portion 230 and the lower surface portion 240 by way of the upper surface portion 210, returns to the upper surface portion 230 and the upper surface portion 210, moves from the upper surface portion 210 to the right side surface portion 250, and finally moves to the refrigerant outlet 214 in the upper surface portion 210.

FIG. 7 illustrates an example refrigerant pipe arranged at five wall surfaces of the evaporator 200. FIG. 8 illustrates an example flow of refrigerant between the five wall surfaces. The left and right wall surfaces may include the left side surface portion 220 and the right side surface portion 250.

In addition, the refrigerant pipe inside the evaporator 200 may be arranged such that the refrigerant moved from the lower surface portion 240 to the upper surface portion 210 reciprocates plural times between the upper surface portion 210 and the right side surface portion 250, and subsequently moves to the refrigerant outlet 214 of the upper surface portion 210.

Since both the refrigerant inlet 212 and the refrigerant outlet 214 are located at the upper surface portion 210, the refrigerant moved to the right side surface portion 250 is required to return to the refrigerant outlet 214 located at the upper surface portion 210.

As the refrigerant pipe is arranged to allow the refrigerant to reciprocate plural times between the upper surface portion 210 and the right side surface portion 250, which enables the efficient cooling of the evaporator 200.

In addition, unlike the illustration, the refrigerant pipe may be divided into two parts or three parts.

The lower surface portion 240 and the upper surface portion 210 are relatively large, and therefore are preferable as a location where the refrigerant pipe is divided into several parts.

Accordingly, the evaporator 200 may be formed by folding a single plate having five surfaces. In addition, expanded left and right side surfaces portions may be integrally formed with the single plate. Of course, a continuous refrigerant flow path may be formed between one refrigerant inlet and one refrigerant outlet throughout the evaporator 200. In this way, the evaporator 200 may be very easily fabricated, and may effectively supply cold air even to the expanded freezing compartment.

Meanwhile, the fixed frames 300 and the elevating frame 400, which are vertically movable, may be used as a shelf assembly which is movable upward or downward.

The bottom plate portion 420 of the elevating frame 400 may be used as a vertically movable shelf, which may be vertically movably supported by the support bars 500.

In this example, the sidewall plate portions 430 of the elevating frame 400 can be omitted. With omission of the sidewall plate portions 430, the drawer 600 may be mounted within the elevating frame 400 so as to be pulled out or pushed into as described above, and the shelf panel 800 mounted above the drawer 600 may be used as a vertically movable shelf.

Although the shelf assembly is vertically moved and supported by the pivoting support bars 500, only vertical movement of a shelf may be realized because the guide protrusions 410 of the elevating frame 400 are inserted into and guided by the vertical guide grooves 310.

For example, with a drive mechanism to move the shelf upward or downward, the shelf performs only vertical movement without front-and-rear movement and left-and-right movement, and thus there occurs no dead space due to horizontal movement of the shelf.

In addition, the support bars 500 used to support the shelf are connected to prevent the shelf from tilting leftward or rightward.

In addition, as the sliding shaft portions 530 provided at one side of the two front and rear support bars 500 are connected respectively to the sliding bars 560, the two support bars 500 pivot at the same angle, which also prevents the shelf from tilting forward or rearward.

In conclusion, with the shelf assembly of the present invention, the shelf remains horizontally without tilting in the front-and-rear direction and in the left-and-right direction, thereby being moved only in the vertical direction.

An operation process of the freezing compartment assembly 100 according to the present invention will be described with reference to FIGS. 9A to 12.

FIGS. 9A to 12 illustrate an example evaporator 200. In this example, the freezing compartment door 130 is omitted. For an instance, the fixed freezing compartment 110 can be omitted.

Figure 9A:
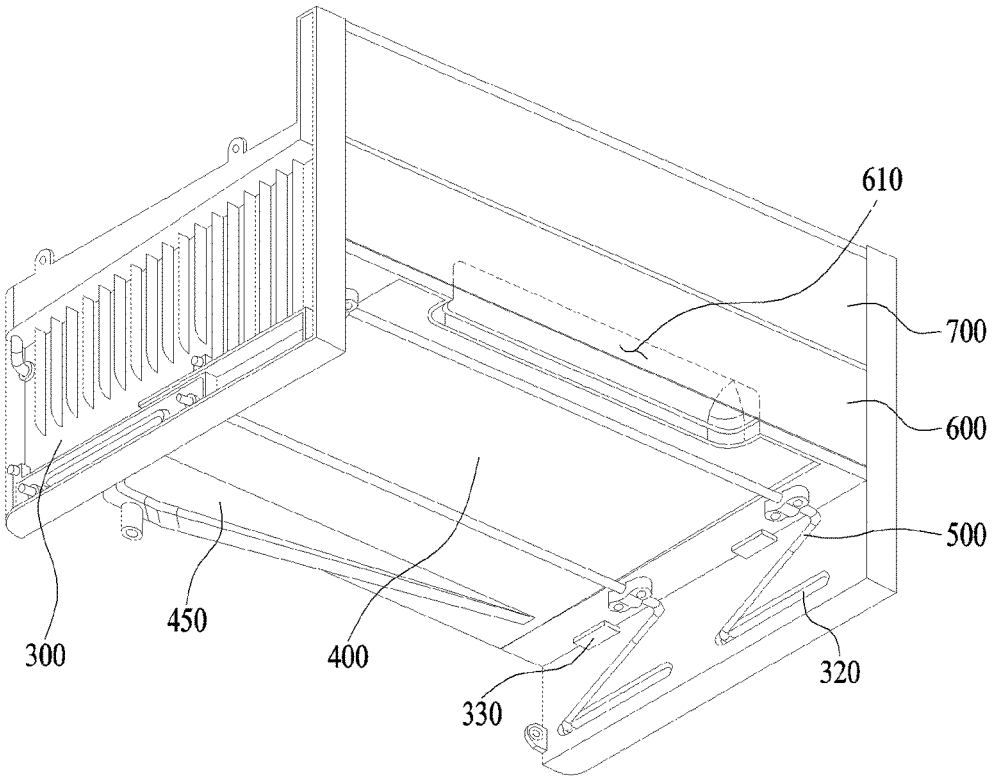
FIGS. 9A and 9B are diagrams illustrating an example state in which an elevating frame is at a downwardly moved position and a pivoting cover blocks the front of an increased freezing compartment space.
Figure 9B:
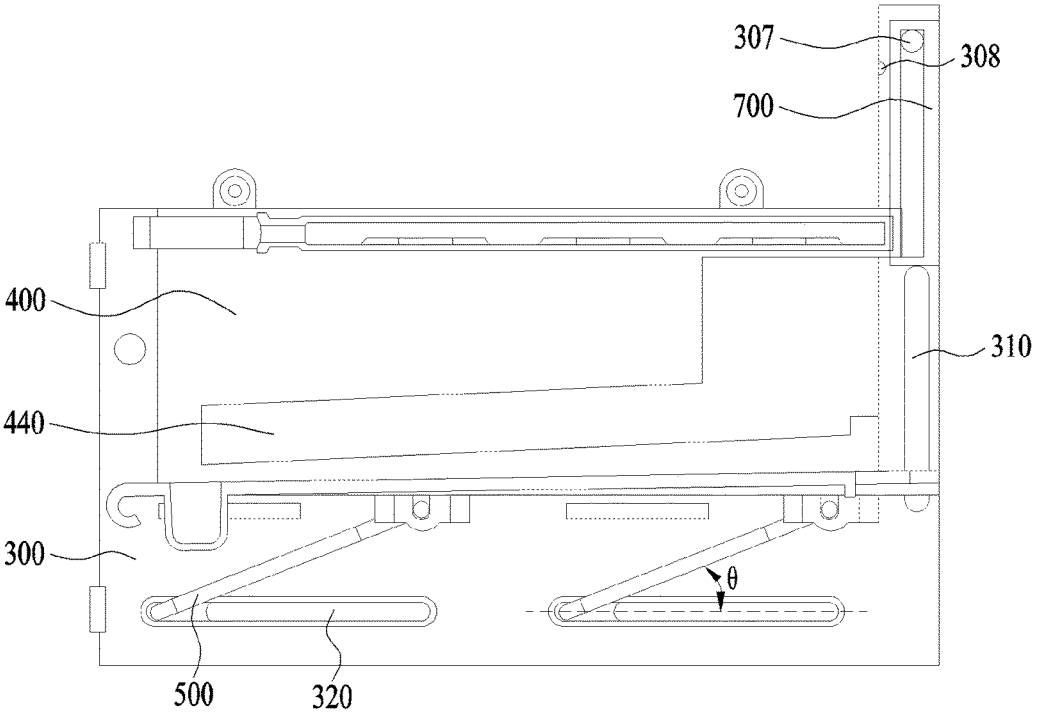

FIGS. 9A and 9B illustrate an example elevating frame 400. The elevating frame 400 is at the downwardly moved position, the support bars 500 are tilted by a prescribed angle θ, and the lower surface of the elevating frame 400 is supported by the support ribs 330.

The drawer 600 is introduced into and supported by the elevating frame 400 and the pivoting cover 700 is vertically oriented to close an opening between the upper end of the front surface of the drawer 600 and the lower surface of the evaporator 200. For example, the pivoting cover 700 serves to close the front side of the expanded freezing compartment.

Referring to FIG. 9B, when the elevating frame 400 is at the downwardly moved position, an angle θ between the support bars 500 and the horizontal guide slots 320 may be 20 degrees or more.

When the angle between the support bars 500 and the horizontal guide slots 320 is excessively small, the user is required to apply large force when moving the elevating frame 400 upward.

As the support angle θ of the support bars 50 is 20 degrees or more at the downwardly moved position, it is possible to reduce force required to move the elevating frame 400 upward.

Figure 10A:
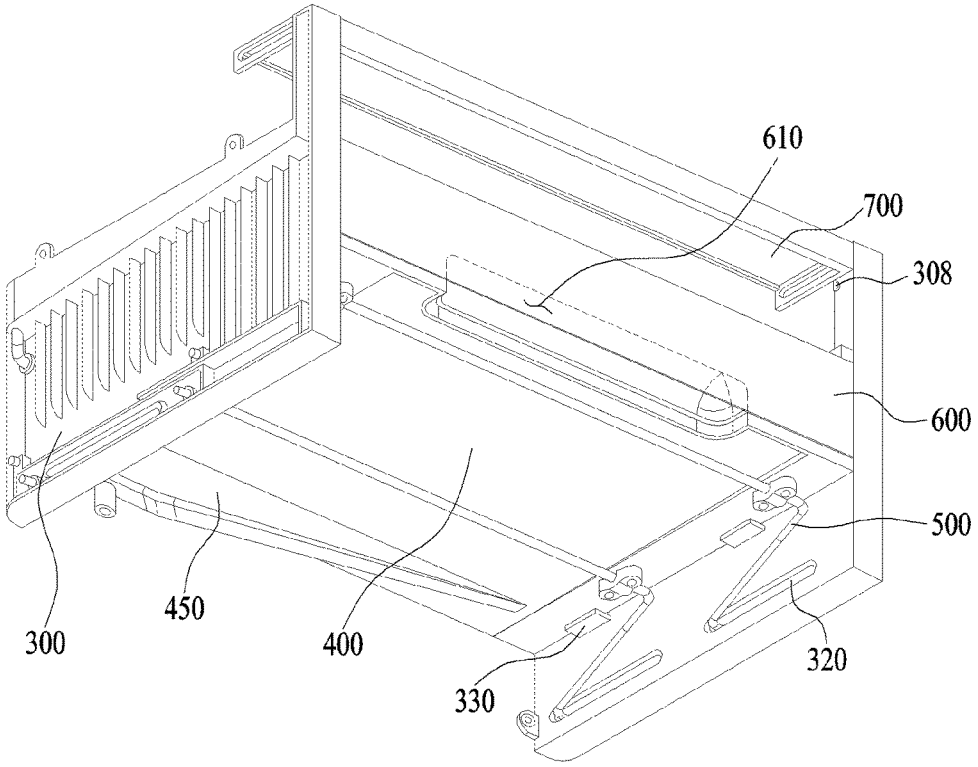
FIGS. 10A and 10B are diagrams illustrating an example state that the elevating frame is moved downwardly and the pivoting cover is pivotably rotated and pushed inward to open the front of the increased freezing compartment space.
Figure 10B:
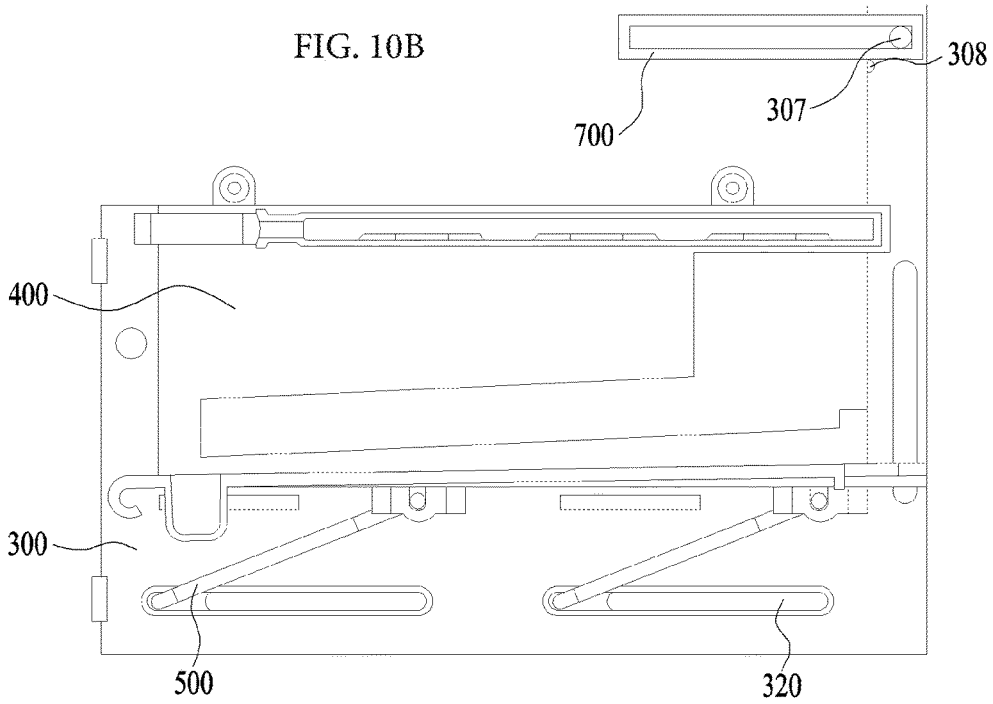

FIGS. 10A and 10B illustrate an example in which a lower portion of the pivoting cover 700 supported by the pivot shafts 307 is pivotably rotated upward and pushed inward.

The extension 305 of the fixed frames 300 is provided at an inner side surface thereof with a semicircular support protrusion 308, which is located at the rear lower side of the pivot shaft 307.

The support protrusion 308 supports the pivoting cover 700 so as to prevent the inwardly pushed pivoting cover 700 from pivoting about the pivot shaft 307 by the weight thereof.

Figure 11A:
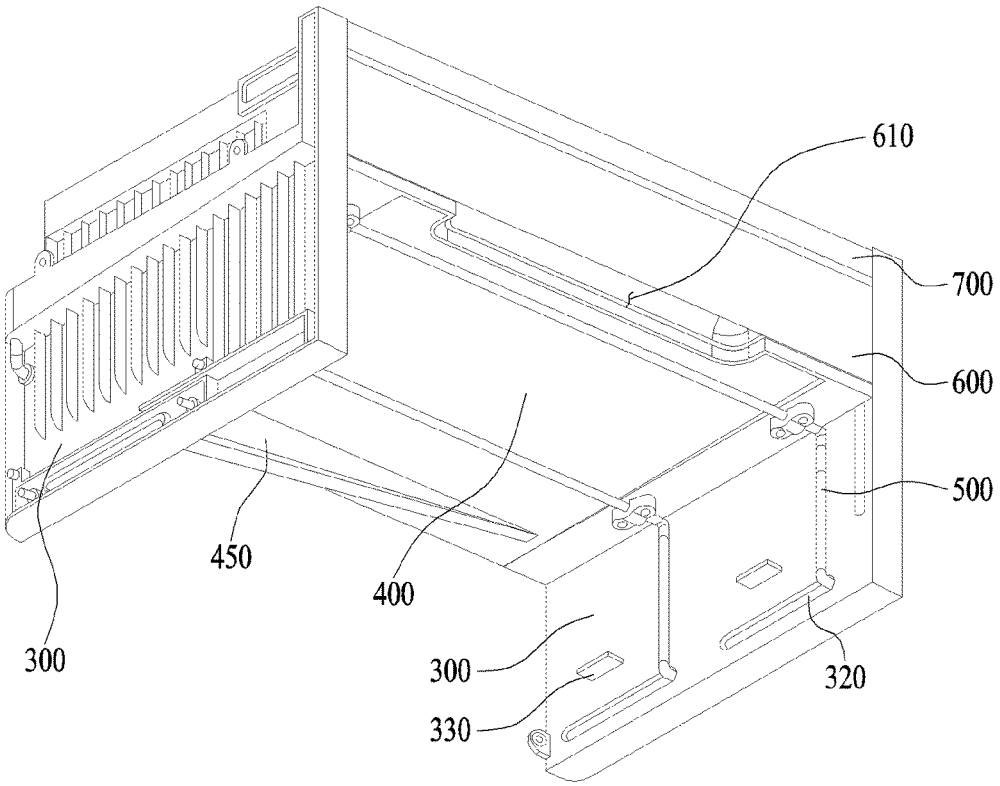
FIGS. 11A and 11B are diagrams illustrating an example state that the elevating frame is moved upwardly.
Figure 11B:
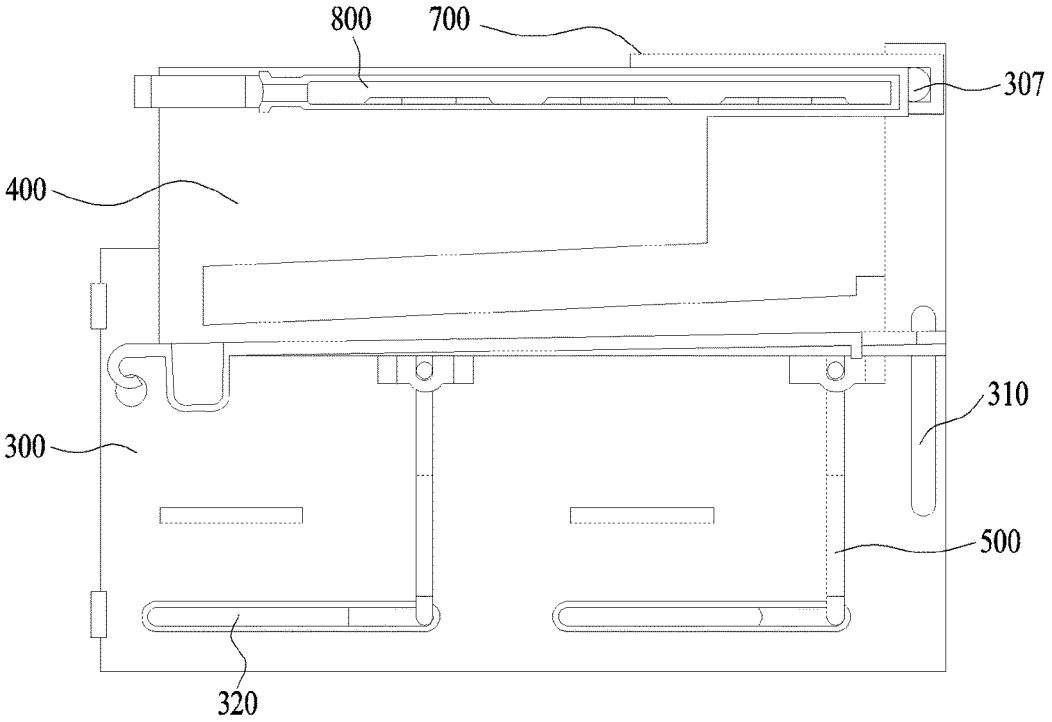

FIGS. 11A and 11B illustrate an example elevating frame 400. The elevating frame 400 is moved upward in a state in which the lower portion of the pivoting cover 700 has pivoted upward and pushed inward.

The user can move the elevating frame 400 upward by lifting the lower surface of the elevating frame 400 by their hands.

Once the elevating frame 400 has been moved upward, the pivoting cover 700 overlaps the shelf panel 800 so as to cover the front surface of the shelf panel 800.

To again move the elevating frame 400 downward, the user can push a lower portion of one side of a front one of the support bars 500 rearward, thus causing the elevating frame 400 to be moved downward by the weight thereof.

Figure 12:
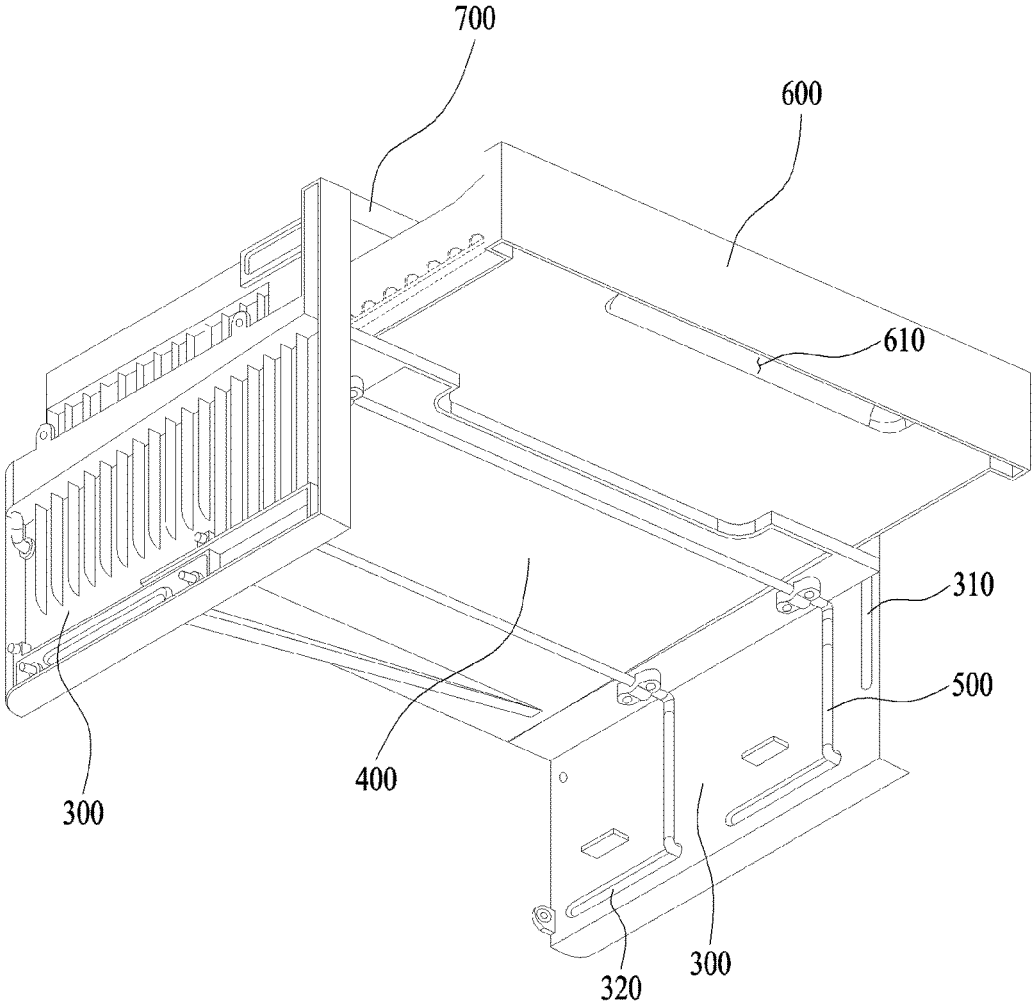
FIG. 12 is a diagram illustrating an example state that a drawer is pulled-out.

FIG. 12 illustrates an example state in which the user pulls the drawer 600 out in the state of FIGS. 11A and 11B.

The drawer 600 may be pulled out regardless of a position of the elevating frame 400.

When the user inserts their fingers into the grip recess 610 and pulls the drawer 600, the drawer 600 may be pulled out until the protruding stopper 625 of the guide rib 620 is caught by the stepped portion 445.

What is claimed is:

1. A refrigerator comprising:

a cabinet;

a storage compartment located in the cabinet;

a door mounted to the cabinet and configured to open or close at least a portion of the storage compartment;

a fixed freezing compartment having a fixed capacity provided in an upper region of the cabinet;

an evaporator configured to define and cool the fixed freezing compartment;

an elevating frame provided at a lower part of the fixed freezing compartment, the elevating frame being configured to move vertically and defining an expanded freezing compartment based on the elevating frame being moved downward; and fixed frames that are secured to respective sidewalls of the storage compartment and that are configured to guide and support vertical movement of the elevating frame.

2. The refrigerator according to claim 1, wherein the fixed frames provided at the respective sidewalls of the storage compartment include a pair of fixed guides, and the elevating frame includes a bottom plate portion extending from a first fixed guide to a second fixed guide in the pair of fixed guides.

3. The refrigerator according to claim 2, further comprising:

a support bar pivotably provided between the elevating frame and the fixed frames, the support bar being configured to guide and support the vertical movement of the elevating frame.

4. The refrigerator according to claim 2, further comprising:

a plurality of support bars pivotably provided between the elevating frame and the fixed frames, the plurality of support bars being configured to guide and support the vertical movement of the elevating frame, and each of the support bars is spaced apart from each other in a front-and-rear direction.

5. The refrigerator according to claim 4, wherein each of the plurality of support bars includes:

a pivot shaft portion rotatably mounted to the bottom plate portion of the elevating frame and configured to support the bottom plate portion across a horizontal direction;

support shaft portions bent from both ends of the pivot shaft portion and configured to support the bottom plate portion vertically; and mounting shaft portions bent from lower ends of the support shaft portions toward the fixed guides and connected to the fixed guides.

6. The refrigerator according to claim 5, wherein the elevating frame is configured to be moved downward relative to the fixed frames as an angle between the bottom plate portion and the support shaft portions is decreased, and the elevating frame is supported at four or more points in all directions by the plurality of support bars.

7. The refrigerator according to claim 6, wherein each fixed frame has a vertical guide groove, and the elevating frame has a guide protrusion configured to be inserted into at least one vertical guide groove to guide vertical movement of the elevating frame.

8. The refrigerator according to claim 6, wherein each fixed guide has a support rib configured to support the elevating frame based on the elevating frame being moved downward.

9. The refrigerator according to claim 2, wherein the elevating frame includes:

sidewall plate portions extending upward from both side ends of the bottom plate portion; and a shelf panel connected to upper ends of the sidewall plate portions and spaced upward apart from the bottom plate portion by a certain distance.

10. The refrigerator according to claim 9, wherein the elevating frame defines a chiller chamber with the bottom plate portion, the sidewall plate portions, and the shelf panel.

11. The refrigerator according to claim 10, further comprising a drawer configured to be pushed into or pulled out of the chiller chamber.

12. The refrigerator according to claim 9, wherein the shelf panel is in contact with the evaporator based on the elevating frame being moved upward, and the expanded freezing compartment is defined between the evaporator and the shelf panel based on the elevating frame being moved downward.

13. The refrigerator according to claim 12, wherein the shelf panel is charged with a cold storage material.

14. The refrigerator according to claim 12, wherein the shelf panel is provided with a pivoting cover, and the pivoting cover is configured to pivot back and forth to open or close a front side of the expanded freezing compartment.

15. The refrigerator according to claim 14, wherein the pivoting cover is configured to slide rearward along the shelf panel based on the elevating frame being moved upward.

16. The refrigerator according to claim 1, wherein the evaporator includes an upper surface portion, a left side surface portion, and a right side surface portion, respectively defining an upper surface, a left side surface, and a right side surface of the fixed freezing compartment.

17. The refrigerator according to claim 16, wherein the evaporator further includes a rear surface portion defining a rear surface of the fixed freezing compartment.

18. The refrigerator according to claim 16, wherein the evaporator further includes a lower surface portion defining a lower surface of the fixed freezing compartment.

19. The refrigerator according to claim 18, further comprising a freezing compartment door configured to open or close the fixed freezing compartment.

20. The refrigerator according to claim 18, wherein the evaporator further includes a left extension and a right extension extending downward from the left side surface portion and the right side surface portion beyond the lower surface portion, and the left extension, the right extension, and the lower surface portion define the expanded freezing compartment based on the elevating frame being moved downward.

21. The refrigerator according to claim 18, wherein the fixed frames are respectively provided with drain grooves, and the drain grooves are located below a left extension and a right extension such that defrosting water generated by the evaporator is introduced into the drain grooves.

22. The refrigerator according to claim 18, wherein the elevating frame is provided at a rear portion of a drain groove such that defrosting water generated by the evaporator is introduced into the drain groove.

23. The refrigerator according to claim 18, wherein the evaporator is a single plate, a rear surface portion of the evaporator is bent from a rear end of the lower surface portion, the upper surface portion is bent from an upper end of the rear surface portion, the left side surface portion is bent from a left end of the upper surface portion, and the right surface portion is bent from a right end of the upper surface portion.

24. The refrigerator according to claim 23, wherein the lower surface portion is welded at left and right ends thereof to the left side surface portion and the right side surface portion to define the fixed freezing compartment.

25. A refrigerator comprising:

a cabinet having a storage compartment;

a door mounted to the cabinet configured to open or close at least a portion of the storage compartment;

a fixed freezing compartment having a fixed capacity defined in an upper region of the cabinet;

a refrigerating compartment defined in a lower region of the cabinet;

an evaporator configured to define and cool the fixed freezing compartment;

an elevating frame configured to define a chiller chamber between the fixed freezing compartment and the refrigerating compartment, the elevating frame (1) provided at a lower part of the fixed freezing compartment, (2) configured to move vertically, and (3) defining an expanded freezing compartment between the fixed freezing compartment and the chiller chamber based on the elevating frame being moved downward; and fixed frames that are secured to respective sidewalls of the storage compartment and that are configured to guide and support vertical movement of the elevating frame.

26. A refrigerator comprising:

a cabinet having a storage compartment, the storage compartment being divided into a fixed freezing compartment having a fixed capacity and a refrigerating compartment;

a door mounted to the cabinet configured to open or close both the fixed freezing compartment and the refrigerating compartment simultaneously; and a freezing compartment assembly provided in an upper region of the cabinet separately from the refrigerating compartment, wherein the freezing compartment assembly includes:

an evaporator including an open front side, a left side surface portion, a right side surface portion, and a lower surface portion, the evaporator defining and cooling the fixed freezing compartment;

an elevating frame provided below the lower surface portion, the elevating frame configured to move vertically and defining an expanded freezing compartment based on the elevating frame being moved downward; and fixed frames that are secured to respective sidewalls of the storage compartment and that are configured to guide and support vertical movement of the elevating frame, the fixed frames defining a space for vertical movement of the elevating frame therein.

27. The refrigerator according to claim 26, wherein the evaporator further includes an upper surface portion, and the fixed freezing compartment has a cuboidal inner space such that a front side of the fixed freezing compartment is open.

28. The refrigerator according to claim 27, wherein the evaporator includes a left extension and a right extension extending downward from lower ends of the left side surface portion and the right side surface portion, and wherein the left extension and the right extension are connected respectively to the fixed frames provided in both sides of the storage compartment.

29. The refrigerator according to claim 28, wherein each fixed frame is provided on an upper surface of a drain groove, and the drain groove is configured to receive defrosting water introduced from the left extension or the right extension.

30. The refrigerator according to claim 27, wherein the elevating fame includes:

a bottom plate portion extending from one fixed frame to the remaining fixed frame;

a shelf plate spaced upward apart from the bottom plate portion configured to define a chiller chamber between the shelf plate and the bottom plate;

a left sidewall plate portion and a right sidewall plate portion provided to connect both ends of the bottom plate portion and the shelf plate to each other; and a drawer configured to be pulled into or pushed out of the chiller chamber.

31. The refrigerator according to claim 30, wherein the freezing compartment assembly further includes a support bar pivotably provided between the elevating frame and the fixed frames, the support bar having a support shaft portion configured to support the elevating frame while moving the elevating frame downward as an angle between the bottom plate portion and the support shaft portion is decreased from a right angle to a certain angle, the support shaft portion forming support points arranged to support at least four locations, including front and rear locations and left and right locations, of the elevating frame.

* * * * *